US009193519B2

(12) United States Patent
Xu

(10) Patent No.: US 9,193,519 B2
(45) Date of Patent: Nov. 24, 2015

(54) AUTOMATIC SHOE COVER DISPENSER

(71) Applicant: Liang Jie Xu, Shanghai (CN)

(72) Inventor: Liang Jie Xu, Shanghai (CN)

(73) Assignee: OTO Industry (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 13/916,558

(22) Filed: Jun. 12, 2013

(65) Prior Publication Data

US 2013/0270288 A1 Oct. 17, 2013

Related U.S. Application Data

(63) Continuation of application No. 12/804,565, filed on Jul. 23, 2010, now Pat. No. 8,490,842, which is a continuation-in-part of application No. 11/729,590, filed on Mar. 28, 2007, now Pat. No. 7,775,396.

(51) Int. Cl.

| | |
|---|---|
| ***B23Q 7/12*** | (2006.01) |
| ***B65H 9/00*** | (2006.01) |
| ***B65D 83/08*** | (2006.01) |
| ***A43B 3/10*** | (2006.01) |
| ***A43B 3/16*** | (2006.01) |
| ***A43D 999/00*** | (2006.01) |
| ***B65H 1/00*** | (2006.01) |

(52) U.S. Cl.

CPC ..... *B65D 83/0894* (2013.01); *A43B 3/106* (2013.01); *A43B 3/163* (2013.01); *A43D 999/00* (2013.01); *B65H 1/00* (2013.01); *B65H 2405/50* (2013.01); *B65H 2701/1212* (2013.01)

(58) Field of Classification Search

CPC ..... B65H 1/00; B65H 2405/50; B65H 2701/1212; B65D 83/0894

USPC ..... 221/191, 171, 111, 232, 112; 223/111, 223/112, 113; 12/1 R, 142 R

See application file for complete search history.

(56) References Cited

U.S. PATENT DOCUMENTS

| | | | | | |
|---|---|---|---|---|---|
| 3,775,793 | A | * | 12/1973 | Casavant et al. | 12/1 R |
| 4,616,428 | A | * | 10/1986 | Leger | 36/7.1 R |
| 4,928,849 | A | * | 5/1990 | Khozai | 221/45 |
| 5,059,277 | A | * | 10/1991 | Willhite et al. | 156/580.1 |
| 5,228,215 | A | * | 7/1993 | Bayer | 36/7.7 |
| 5,394,624 | A | * | 3/1995 | Siepser | 36/9 R |
| 5,787,607 | A | * | 8/1998 | Schurch | 36/7.1 R |
| 5,845,416 | A | * | 12/1998 | Hands | 36/2 R |
| 5,946,822 | A | * | 9/1999 | Maturaporn | 36/9 A |
| 5,983,526 | A | * | 11/1999 | Pawlik et al. | 36/7.1 R |
| 5,996,258 | A | * | 12/1999 | Simmons | 36/72 R |
| 6,219,938 | B1 | * | 4/2001 | Anderson | 36/7.1 R |
| 6,339,888 | B1 | * | 1/2002 | Brunson et al. | 36/7.1 R |
| 6,543,075 | B2 | * | 4/2003 | Gultekin et al. | 12/1 R |
| 6,666,479 | B1 | * | 12/2003 | Maddaleni | 280/825 |
| 7,108,154 | B1 | * | 9/2006 | Thompson | 221/33 |
| 7,440,816 | B1 | * | 10/2008 | He et al. | 700/231 |
| 7,448,521 | B2 | * | 11/2008 | Hu | 223/111 |
| 7,540,987 | B1 | * | 6/2009 | Graf et al. | 264/223 |

(Continued)

*Primary Examiner* — Rakesh Kumar

(74) *Attorney, Agent, or Firm* — Raymond Y. Chan; David and Raymond Patent Firm

(57) ABSTRACT

An automatic shoe cover dispenser includes a shoe cover feeding arrangement holding a plurality of shoe covers each having a shoe opening; and a shoe cover pulling mechanism for pulling one of the shoe covers into an open-up condition as a standby shoe cover and being ready for putting on a user's shoe, wherein after the standby shoe cover is dispensed for being worn at the shoe of the user, the shoe cover at a subsequent position is pulled into the open-up condition.

4 Claims, 24 Drawing Sheets

(56) References Cited

U.S. PATENT DOCUMENTS

| | | | | |
|---|---|---|---|---|
| 7,614,138 | B2 * | 11/2009 | Asici et al. | 29/700 |
| 7,634,862 | B2 * | 12/2009 | Cockman | 36/138 |
| D611,684 | S * | 3/2010 | Bell | D2/909 |
| 7,669,351 | B1 * | 3/2010 | Ghotbi | 36/7.1 R |
| 7,757,910 | B2 * | 7/2010 | Levine et al. | 223/113 |
| 7,775,396 | B2 * | 8/2010 | Xu | 221/191 |
| D625,086 | S * | 10/2010 | Key | D2/914 |
| 8,186,548 | B2 * | 5/2012 | Levine et al. | 223/113 |
| 8,245,385 | B2 * | 8/2012 | He et al. | 29/701 |
| 8,490,842 | B2 * | 7/2013 | Xu | 223/111 |
| 2006/0144879 | A1 * | 7/2006 | Hu | 223/111 |
| 2007/0163912 | A1 * | 7/2007 | Chen | 206/477 |
| 2007/0204568 | A1 * | 9/2007 | Chen | 53/459 |
| 2008/0000035 | A1 * | 1/2008 | Levine et al. | 12/1 R |
| 2008/0237277 | A1 * | 10/2008 | Xu | 222/526 |
| 2009/0071989 | A1 * | 3/2009 | He et al. | 223/111 |
| 2009/0152312 | A1 * | 6/2009 | Li | 223/113 |
| 2010/0065592 | A1 * | 3/2010 | Fard | 223/113 |
| 2010/0257749 | A1 * | 10/2010 | Levine et al. | 36/7.1 R |
| 2010/0288800 | A1 * | 11/2010 | Xu | 223/113 |
| 2011/0272440 | A1 * | 11/2011 | Heller | 223/113 |
| 2012/0286471 | A1 * | 11/2012 | Grauzer et al. | 273/149 R |
| 2013/0270288 | A1 * | 10/2013 | Xu | 221/1 |

* cited by examiner

AUTOMATIC SHOE COVER DISPENSER

CROSS REFERENCE OF RELATED APPLICATION

This is a Continuation application that claims the benefit of priority under 35 U.S.C. §119 to a non-provisional application, application Ser. No. 12/804,565, filed Jul. 23, 2010, which is a CIP application that claims the benefit of priority under 35 U.S.C. §119 to a non-provisional application, application Ser. No. 11/729,590, filed Mar. 28, 2007.

BACKGROUND OF THE PRESENT INVENTION

1. Field of Invention

The present invention relates to a shoe cover machine, and more particularly to an automatic shoe cover dispenser.

2. Description of Related Arts

Automatic shoe cover machine is a device designed to solve the problem of having people to change their shoes before entering a room under sanitary control, wherein the user is merely required to have his or her foot with the shoe on it to step on the automatic shoe cover machine, then a shoe cover will automatically be shredded and wrapped up his/her shoe. Currently, automatic shoe cover machines are widely used in public health establishments, like hospital, laboratory, living room and other sanitation environments.

A conventional automatic shoe cover machine invented by the applicant of this application in 2000, generally uses shoe cover which has four fitting pins. The shoe covers are disposed in the machine by mounting the four fitting pins on the machine one by one. The difficulty of mounting the shoe covers on the shoes resulting in inconvenience and impractical use. Another conventional automatic shoe cover machine invented by the applicant does overcome disadvantages of the prior art machine by mounting the shoe covers on the machine without fitting pins while it is controlled by computer. However, due to the use of computer control, it has a relatively high cost that fails to meet the market demand. It is not suitable for the general consumes. At the same time, the lack of fitting pins leads to an unstable work process of the machine.

SUMMARY OF THE PRESENT INVENTION

The invention is advantageous in that it provides a stable and efficient automatic shoe cover dispenser which mechanical structure ensures a stable and efficient working process.

Another advantage of the invention is to provide an automatic shoe cover machines providing innovative shoe covers for users through stable and efficient working procedures that effectively prevents the conventional shortcomings such as complicated shoe cover installations and high manufacture cost.

Another advantage of the invention is to provide an automatic shoe cover dispenser, which uses exclusive shoe covers, which can be steadily hanged on a shoe cover bar without complex operations, even the former shoe covers have not be completely dispensed.

Another advantage of the invention is to provide an automatic shoe cover dispenser, which is simple in structure with inexpensive manufacture and maintenance cost.

Additional advantages and features of the invention will become apparent from the description which follows, and may be realized by means of the instrumentalities and combinations particular point out in the appended claims.

According to the present invention, the foregoing and other objects and advantages are attained by an automatic shoe cover dispenser, comprising:

a shoe cover feeding arrangement holding a plurality of shoe covers each having a shoe opening;

a pulling mechanism which is capable of pulling one of the shoe covers from the shoe cover feeding arrangement as a standby shoe cover for being ready for wearing to on a shoe of a user; and a driving mechanism, comprising a pedal arranged in up and down movable manner for the shoe of the user to step thereon and means for driving the pulling mechanism to deliver the standby shoe cover to the pedal and enlarging the shoe opening of the standby shoe cover to be large enough for the shoe of the user to place inside the standby shoe cover by means of up and down movements of the pedal.

According to the present invention, the shoe opening of each of the shoe cover has an elastic peripheral edge provided therearound. The driving mechanism is constructed in a manner that when a downward force is applied to the pedal to press the pedal downward, the pulling mechanism is actuated to deliver the standby shoe cover above the pedal and the shoe opening is enlarged by applying a separating force to move the elastic peripheral edge apart by the driving mechanism. Then, the pedal is driven upwards again by the driving mechanism. When the pedal is pressed downward again, the standby shoe cover is detached from the shoe cover feeding arrangement and the separating force applied to the elastic peripheral edge is released by means of the driving mechanism for wearing the standby shoe cover on the shoe of the user that steps on the pedal to press the pedal to move up and down.

In accordance with another aspect of the invention, the present invention comprises an automatic shoe cover dispenser, comprising:

a shoe cover feeding arrangement holding a plurality of shoe covers each having a shoe opening; and a shoe cover pulling mechanism for pulling one of the shoe covers into an open-up condition as a standby shoe cover and being ready for putting on a user's shoe, wherein after the standby shoe cover is dispensed for being worn at the shoe of the user, the shoe cover at a subsequent position is pulled into the open-up condition.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 10 of the drawings, an automatic shoe cover dispenser, according to a preferred embodiment of the present invention is illustrated, in which the automatic shoe cover dispenser comprises a frame 1, a plurality of shoe covers 5 which are ready for being worn on a shoe of a user, a shoe cover pulling mechanism A1 adapted for pulling out the shoe covers 5 into a standby condition for being ready for putting on user's shoe, i.e. wrapping up the shoe, a driving mechanism A2 adapted for driving the shoe cover pulling mechanism A1 and a shoe cover feeding arrangement A3 adapted for feeding shoe covers 5.

Figure 1:
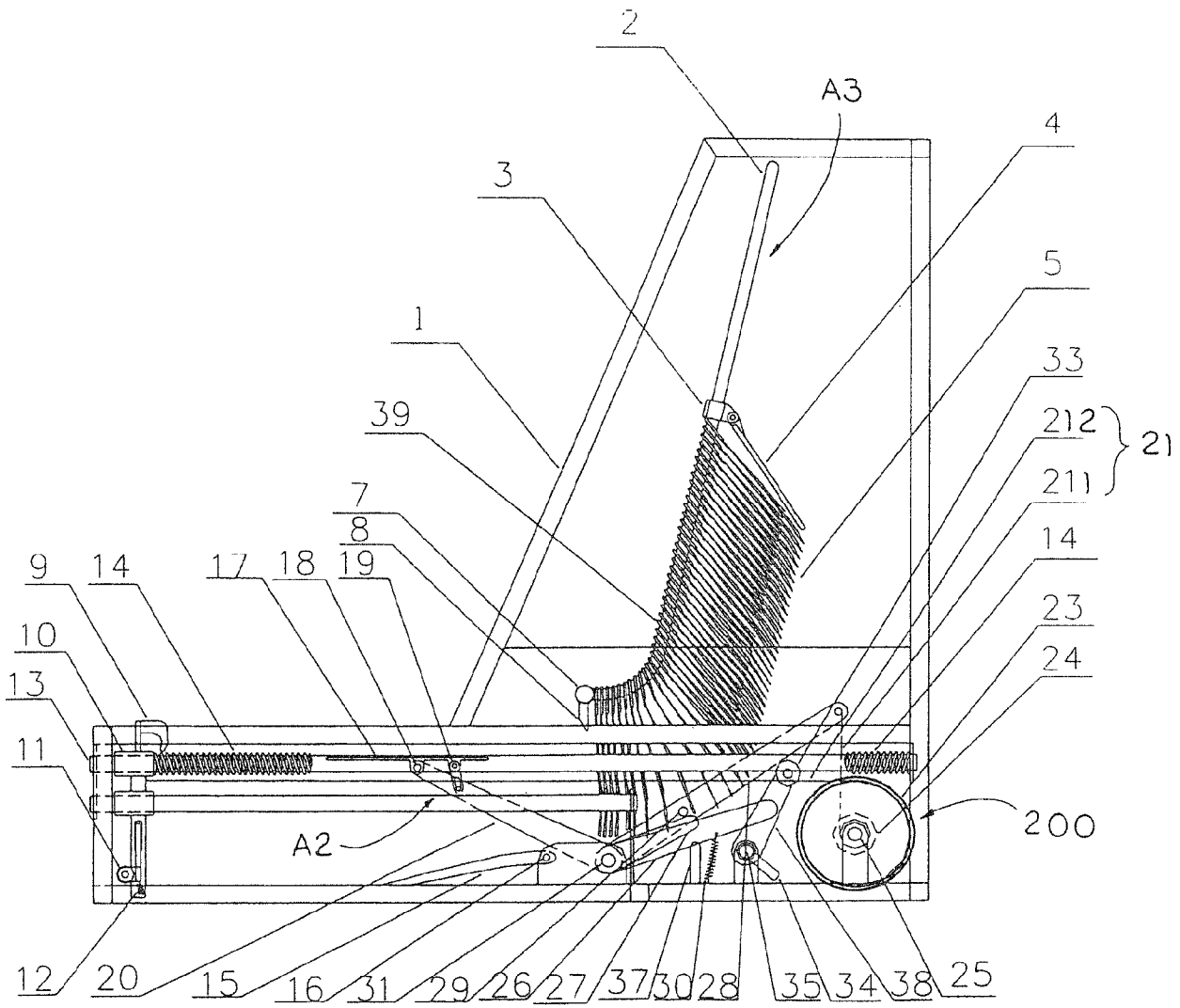
FIG. 1 is a perspective view of an automatic shoe cover dispenser according to a preferred embodiment of the present invention.
Figure 2:
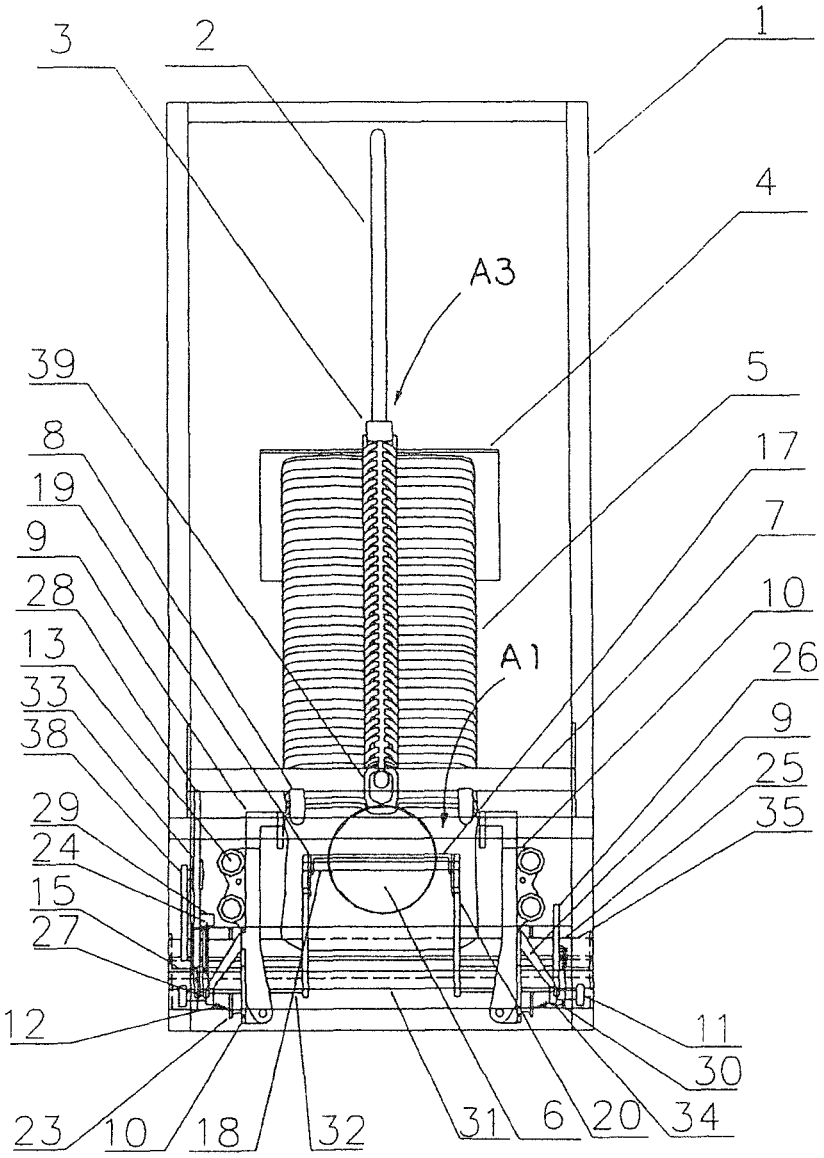
FIG. 2 is a side sectional view of the automatic shoe cover dispenser according to the above preferred embodiment of the present invention.
Figure 3:
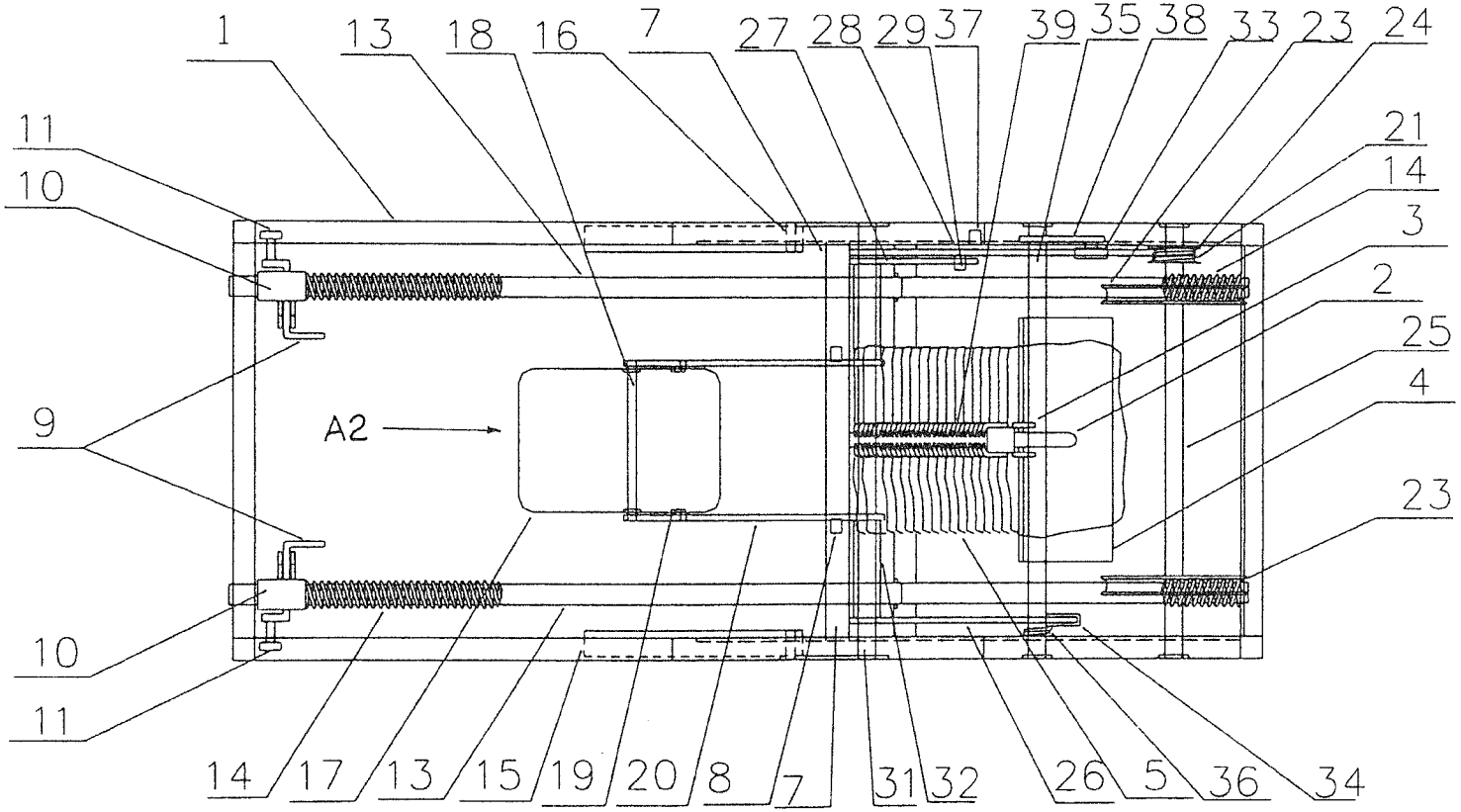
FIG. 3 is a top sectional view of the automatic shoe cover dispenser according to the above preferred embodiment of the present invention.

Referring to FIG. 1, FIG. 2 and FIG. 3 of the drawings, the shoe cover pulling mechanism A1 comprises one or more fixed members 8 each being embodied as a hook shaped member firmly mounted on the frame 1, one or more active members 9 each being embodied as a hook shaped member movably mounted on a rack 13 provided in the frame 1. The active member 9 is adapted for moving along the rack 13 and cooperating with the fixed member 8 in such a manner that one of the shoe covers 5 is capable of being placed between the fixed members 8 and the active members 9 and pulling the shoe cover 5 into an open-up condition and being ready for putting on a user's shoe.

The driving mechanism A2 comprises a pedal 17 provided in the frame 1 in such a manner that when the pedal 17 is stepped down, the active members 9 are driven to cooperate with the fixed members 8 to pull out one of the shoe covers 6.

According to the preferred embodiment of the present invention, a pedal shaft 18 is provided and the pedal 17 is pivotally connected with the pedal shaft 18. According to the preferred embodiment of the present invention, the pedal 17 comprises a pair of linkage arms 20 pivotally connected to two end portions of the pedal shaft 18. Moreover, a pair of balance arms 19 is provided between the pedal 17 and the linkage arms 20 for balancing the movement of the petal 17 while it is stepping down to ensure a steady motion for the user. A pair of connecting shells 32 is provided at two end portions of the linkage shaft 31 to ensure the linkage arms 20 being extended in a parallel manner.

Figure 9:
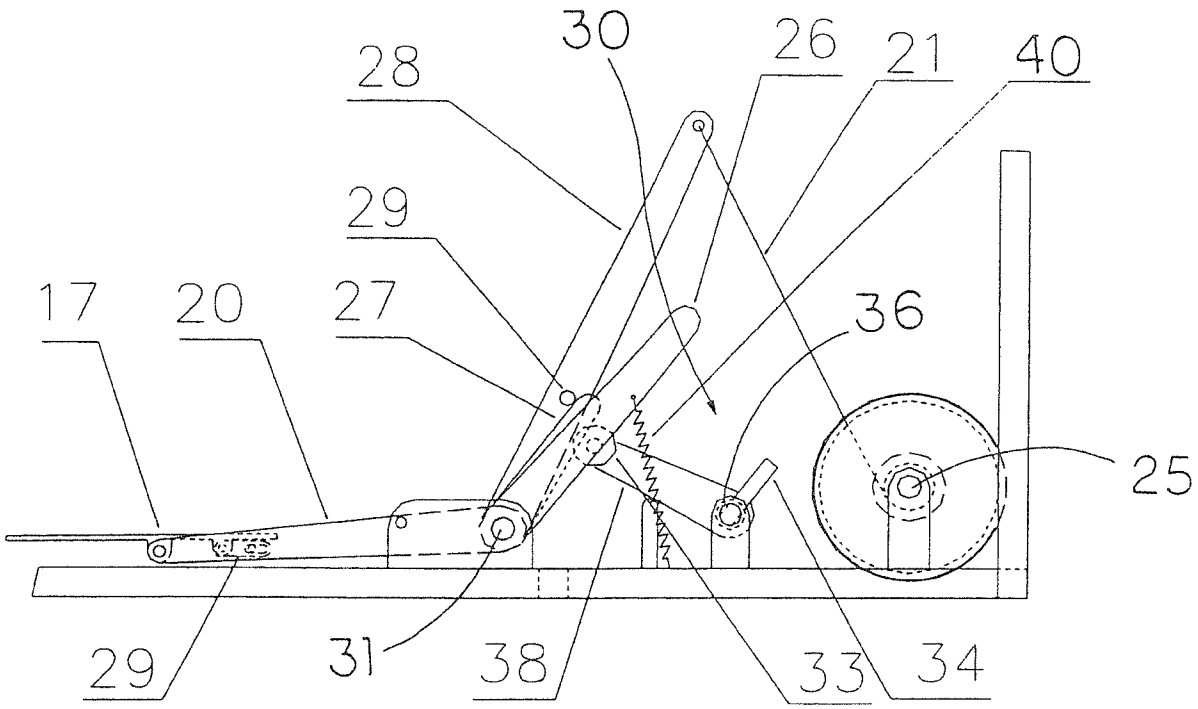
FIG. 9 is a schematic diagram of a working process of a buffer unit of the automatic shoe cover dispenser according to the above preferred embodiment of the present invention, illustrating the locked state of the buffer unit.

A draw bar 26 is pivotally connected with the linkage arms 20 via a linkage shaft 31 in order to link the petal 17 with the draw bar 26. An auxiliary arm 28 has a lower end is pivotally connected to the linkage shaft 31 and is upwardly and inclinedly extended for assisting the movement of the linkage arms 20. Furthermore, a linkage resilient element 40 such as a spring is connected between the draw bar 26 and a bottom of the frame 1 to reserve a resilient force to the draw bar 26 when a downward force is applied to the petal 17 as shown in FIG. 9 for pulling the petal 17 returning to original position when the downward force is released.

The draw bar 26 having a front end and a rear end, a drag unit 21 wound round a wheel unit 200 mounted in the frame 1, wherein the rear end of the draw bar 26 is pivotally connected to the linkage shaft 31 so as to pivotally link with the pedal 17, and the drag unit 21 links the front end of the draw bar 26 with the active members 9 in such a manner that when the pedal 17 is stepped down, the pedal 17 drives the draw bar 26 to drag the drag unit 21 so as to driving the active members 9 linked with the drag unit 21 to move along the racks 13 and cooperating with the fixed members 8 to pull out one of the shoe covers 6.

The shoe cover feeding arrangement A3 comprises a feeding rod 2 upwardly and inclinedly extended in the frame 1, wherein each of the shoe covers 5 comprises a sliding element 3 through which the shoe covers 5 are hanged along the feeding rod 2. According to the preferred embodiment of the present invention, a position plate 4, which is mounted on the feeding rod 2, is placed on top of the shoe covers hanged along the feeding rod 2 for pushing the shoe covers 5 toward the fixed members 8.

According to the preferred embodiment of the present invention as shown in FIG. 3, the pair of racks 13 is provided and each rack 13 is equipped with an elastic member 14 thereon. A sliding member 10 is coupled with each rack 13 and the active members 9 are movably mounted on the racks 13 via the sliding members 10 respectively. And the drag unit 21 also is linked to the active members 9 via the sliding members 10.

Each of the elastic members 14 has a front end extended to the front of the frame 1 and a rear end connected with the respective active member 9 through the sliding member 10. Thus, when the pedal 17 is stepped down, the elastic members 14 are compressed when the active members 9 move to the fixed members 8. When the force applied on the pedal 17 is released, the active members 9 are capable to move back along the racks 13 by means of the force of the compressed elastic members 14. A frame bar 7 is transversely mounted across a middle portion of the frame 1. According to the preferred embodiment of the present invention as shown in FIG. 3, there is a pair of fixed members 8 spacedly and firmly mounted on the frame bar 7.

According to the preferred embodiment of the present invention as shown in FIG. 3, the wheel unit 300 comprises first and second roller wheels 23, 24 coaxially and pivotally connected to a wheel shaft 25 of the frame 1. The first roller wheel 23 has a larger diameter 23 and the second roller wheel 24 has a smaller diameter. The drag unit 21 comprises a rope like first drag element 211 and a rope like second drag element 212 wound round the first roller wheel 23. The first drag element 21 which winds round the second roller wheel 24 is linked to the auxiliary arm 28. The second drag element 22 is linked to the sliding members 10 of the active members 9. When the first drag element 211 drives the second roller wheel 24 to rotate due to the movement of the auxiliary arm 28, the first roller wheel 23 following the rotation of the second roller wheel 24 drives the second drag element 212 to displace. Such that the active members 9 are capable to move in a long way so as to adequately pull out the shoe cover 5 to the standby condition.

The auxiliary arm 28 has a predetermined length which is long enough that when the petal 17 has a certain displacement, the extended end of the auxiliary arm 28 which connects with the first drag element 211 will have a relatively larger movement so as to drive the first drag element 211 to generate a longer displacement.

Figure 5B:
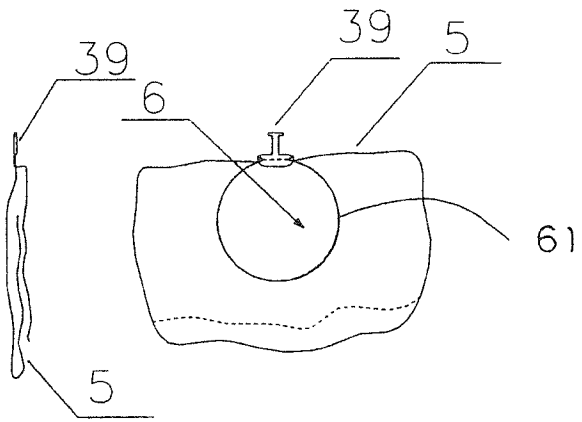
FIG. 5*b* is a perspective view of a shoe cover used the automatic shoe cover dispenser according to the above preferred embodiment of the present invention.
Figure 5A:
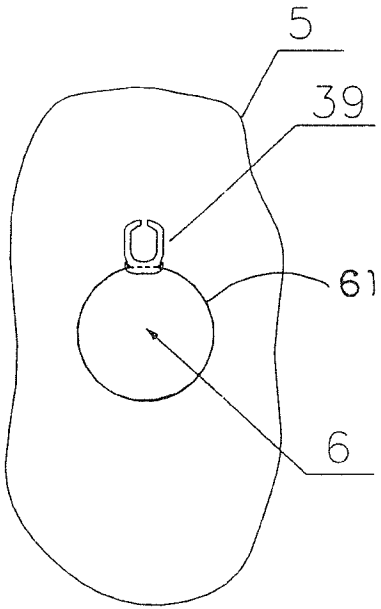
FIG. 5*a* is a perspective view of an original shoe cover before used in the automatic shoe cover dispenser according to the above preferred embodiment of the present invention.

Referring to FIG. 5*a* and FIG. 5*b* of the drawings, the shoe cover 5 is made of durable, soft and/or elastic material, such as soft plastic. Each of the shoe covers 5 is constructed in a pocket structure adapted to wrap up a user's shoe, as shown in FIG. 5*a*, wherein the shoe covers 5 hanged along the feeding rod 2 are arranged in the standby condition, as shown in FIG. 5*b*. The shoe opening 6 has an elastic peripheral edge 61 providing an elastic effect by means of, for example, an elastic cord affixed around the circumference of the shoe opening 6 such that the shoe cover 5 is adapted to being pulled out to the standby condition. Each of the shoe covers 5 further comprises a holding member 39 provided adjacent to the shoe opening 6 thereof in such a manner that the shoe cover 5 is capable to being hanged on the feeding rod 2 through the holding member 39.

Figure 4A:
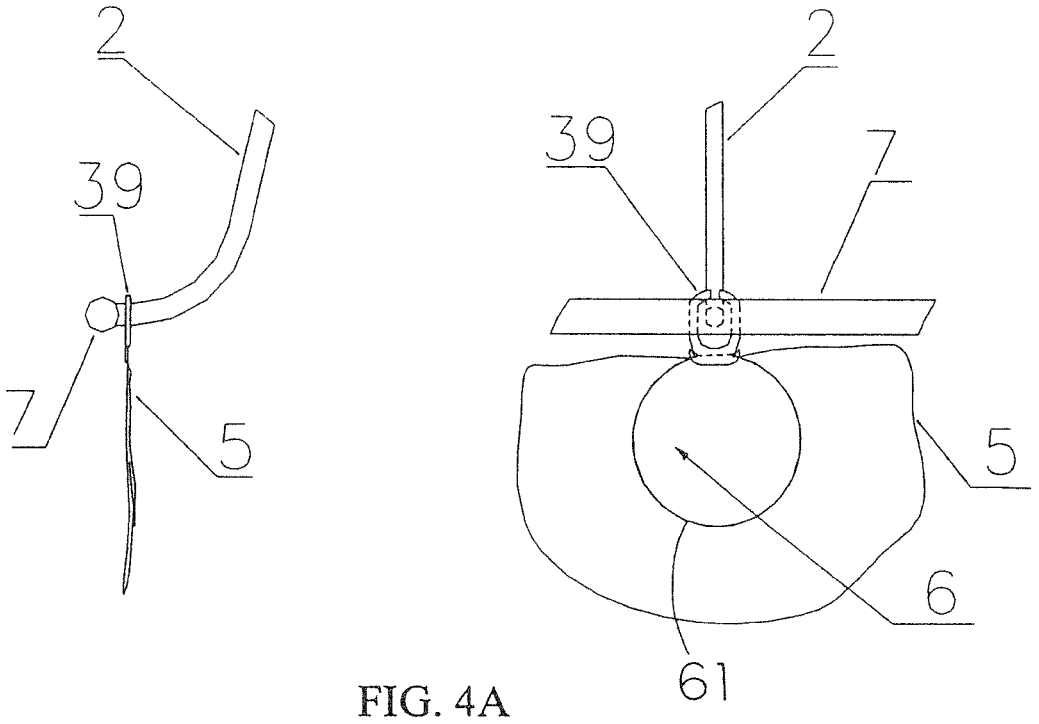
FIG. 4*a* is a perspective view of a shoe cover bar of the automatic shoe cover dispenser according to the above preferred embodiment of the present invention.
Figure 4B:
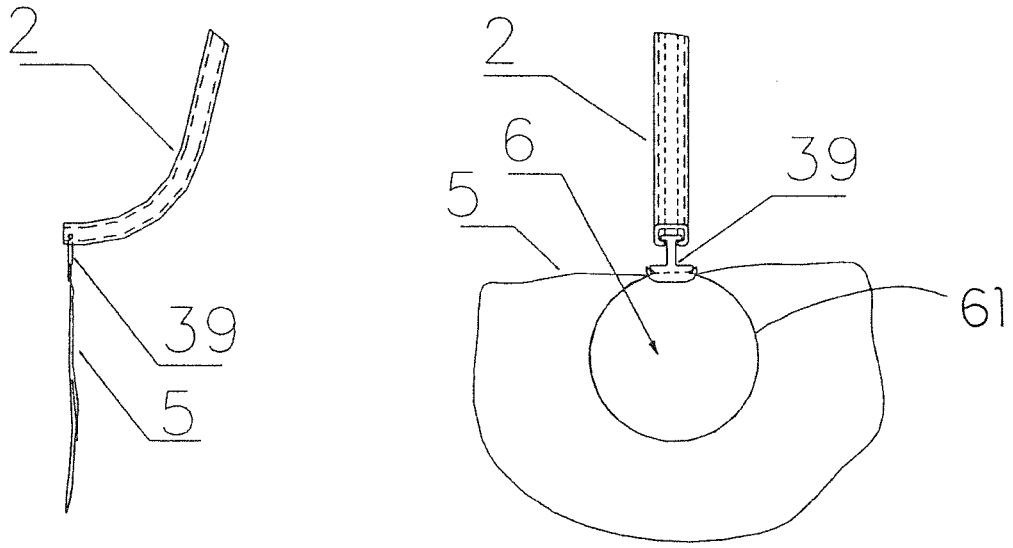
FIG. 4*b* is a perspective view illustrating another alternative mode of the automatic shoe cover dispenser according to the above preferred embodiment of the present invention.

It is appreciated that there are various alternative modes of connection relation between the shoe covers 5 and the feeding rod 2. According to the present invention, two different embodiments of the shoe covers 5 are illustrated to comply with different modes of feeding rod 2. Accordingly, two types of holding member 39 are embodied and illustrated in the preferred embodiment of the present invention, as illustrated in FIGS. 4*a* to 5*b*, for connecting with the feeding rod 2. As shown in FIGS. 4*a* and 5*a* of the drawings, the feeding rod 2 has a circular cross-section, the connecting part of the holding member 39 has a ring shape correspondingly to mating with the feeding rod 2. In another alternative mode of the connection relations between the shoe cover 5 and the feeding rod 2, as shown in FIGS. 4*b* and 5*b* of the drawings, the feeding rod 2 is a hollow rod and the connecting part of the holding member 9 is in a "T" shape correspondingly to mating with the feeding rod 2.

Figure 7:
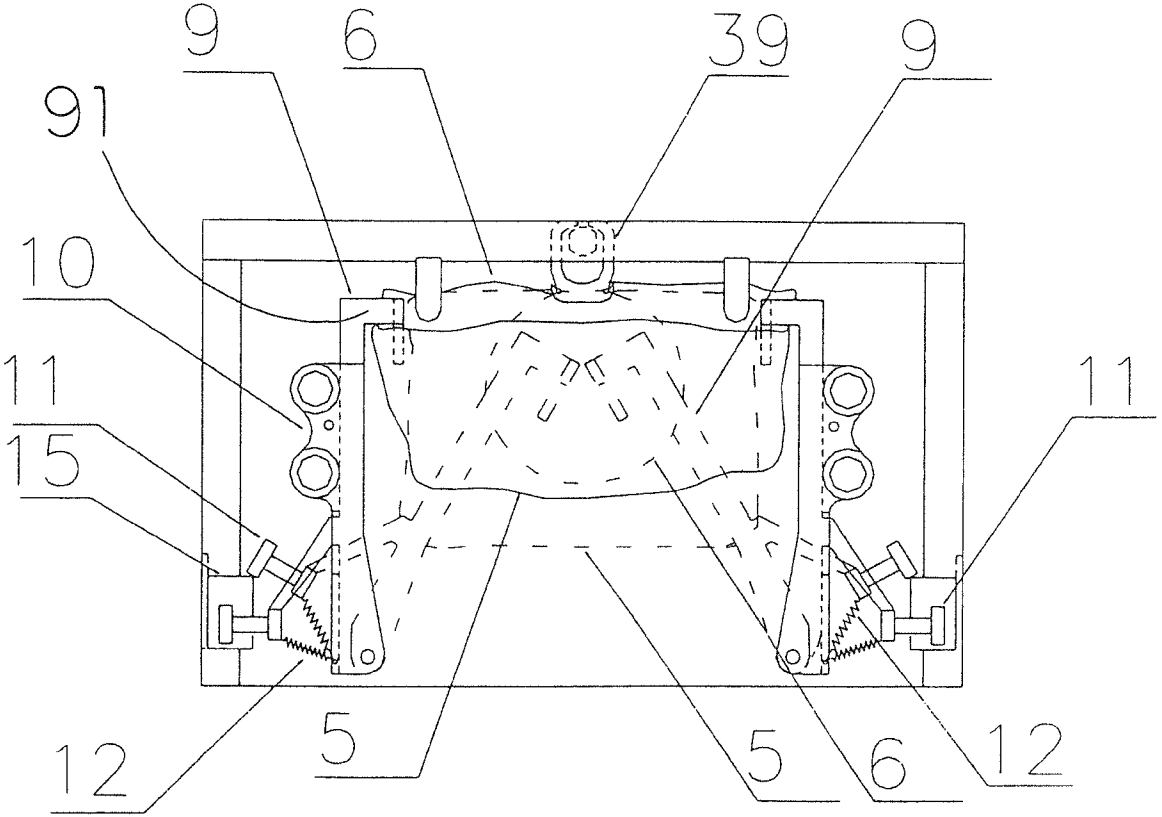
FIG. 7 is a schematic diagram of the above working process of the automatic shoe cover dispenser according to the above preferred embodiment of the present invention, illustrating the hitch process about an active member cooperated with a fixed member to hitch shoe opening of a shoe cover.

Referring to the FIG. 7 of the drawings, the shoe cover pulling mechanism A1 comprises a pair of sliding guides 15 mounted on the frame 1. The active members 9, mounted on the sliding members 10 in a pin joint manner. Each of the active members 9 comprises a clasping element 91 which is a crook structure on a top end thereof for clasping the shoe opening 6 of the shoe cover 5 and a bearing 11 with a reset unit 12 such as spring provided on a lower end thereof.

When the active members 9 and the sliding members 10 are driven by the second drag element 212 to overcome the resilient force of the elastic members 14 and reserve an elastic energy and to move to the fixed members 8 along the racks 13, the bearings 11 with the reset units 12 of the active members 9 slide along the sliding guides 15 so as to render the active members 9 to move downwardly, wherein the clasping elements 91 move inwardly to enable the clasping elements, i.e. the crook structures, of the active members 9 to adequately contact and effectively pull out the shoe opening 6 of the respective shoe cover 5 to the open-up condition. According to the preferred embodiment of the present invention, each of the sliding guides 15 is mounted on the frame 1 through a sliding guide shaft 16 provided in the frame 1.

Figure 8:
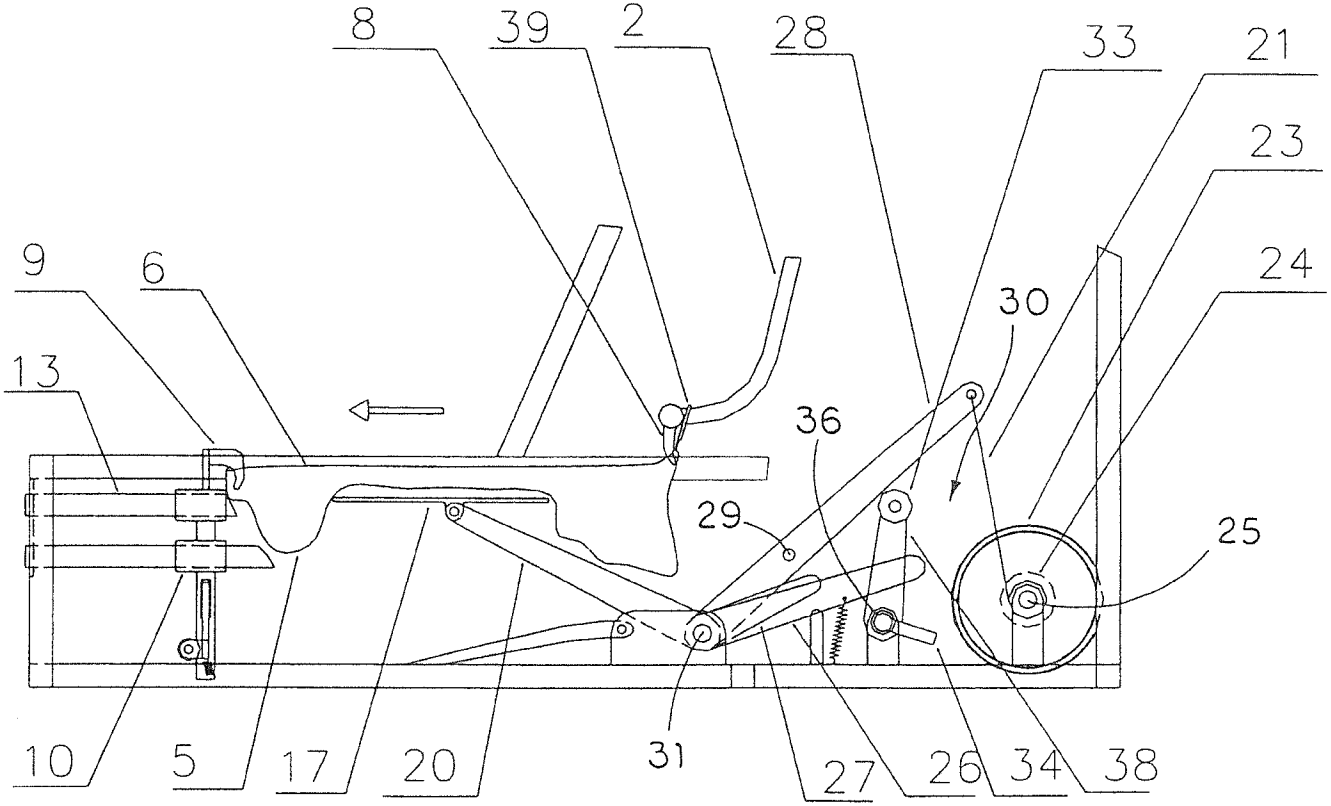
FIG. 8 is a schematic diagram of the above working process of the automatic shoe cover dispenser according to the above preferred embodiment of the present invention, illustrating the pull process about the active member cooperated with the fixed member to pull out shoe opening of a shoe cover into an unwrapped manner.
Figure 10:
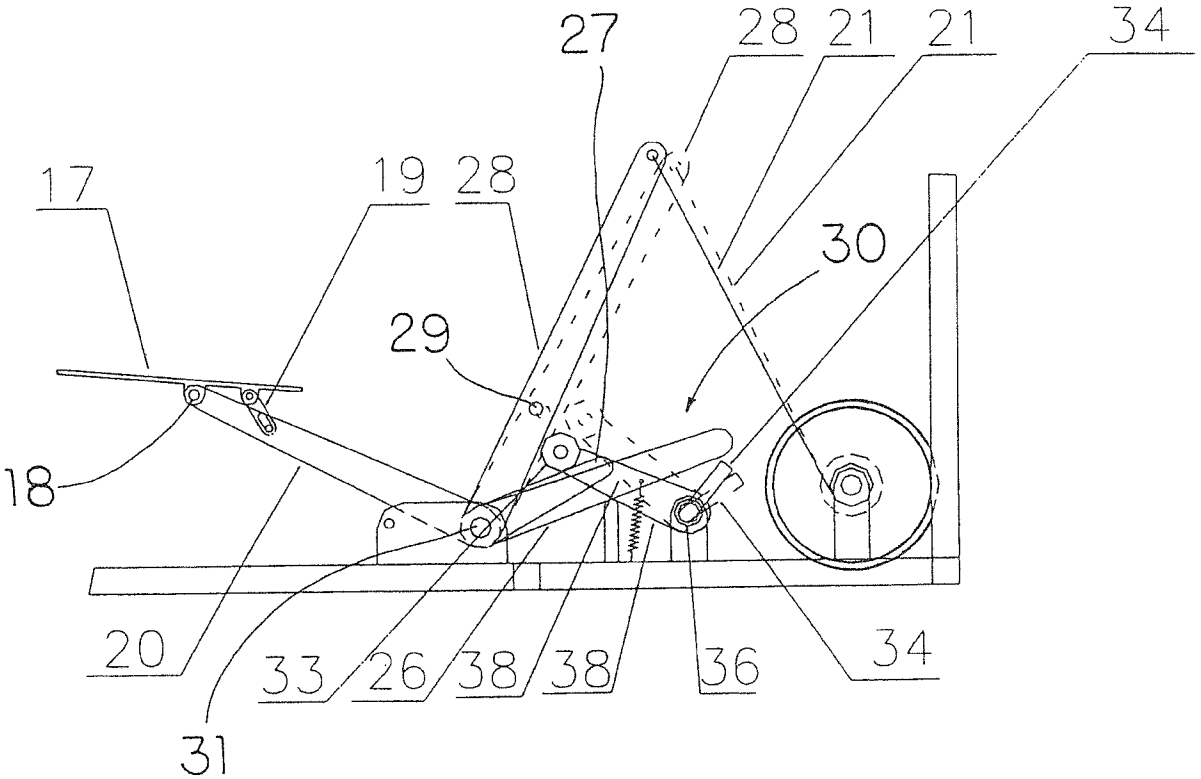
FIG. 10 is a schematic diagram of a working process of a buffer unit of the automatic shoe cover dispenser according to the above preferred embodiment of the present invention, illustrating the unlocked state of the buffer unit.

According to the preferred embodiment of the present invention, referring to FIGS. 8 to 10 of the drawings, the automatic shoe cover dispenser further comprises a buffer unit 30 provided in the frame 1. The buffer unit 30 comprises a driving arm 27 pivotally connected to the linkage shaft 31 so as to linked with the pedal 17, a buffer arm 38 having a buffer bearing 33 provided at an upper end thereof being pivotally mounted to the frame 1, and a resilient element 36 mounted on the buffer arm 38.

The driving arm 27 drives the buffer arm 38 rotating and displacing to a position that the buffer arm 38 with the buffer bearing 33 and the draw bar 26 are in a tangency manner. Therefore, the buffer unit 30 is adapted for making the draw bar 26 standing in a temporary stillness state so as to avoid the active members 9 timely draw back along the racks 13 under the force of the elastic members 14 so that the user will have enough time to remove his/her feet from the pedal 17 of the automatic shoe cover dispenser.

The auxiliary arm 28 has a linkage pin 29 provided thereon, wherein the driving arm 27 works with the linkage pin 29 when it is rotating so as to assist the auxiliary arm's rotation movement.

According to the preferred embodiment of the present invention, the buffer unit further comprises a buffer pin 34 provided on the buffer arm 38, wherein the buffer min 28 mounted on the frame 1 via a buffer shaft 35. Furthermore, a banking block 37 is mounted on the frame 1 adapted for limiting the overage shift of the buffer arm 38.

As a result, referring to FIG. 6, FIG. 7, FIG. 8, FIG. 9 and FIG. 10 of the drawings, according to the preferred embodiment of the present invention, a working process of the automatic shoe cover dispenser is illustrated.

Figure 6:
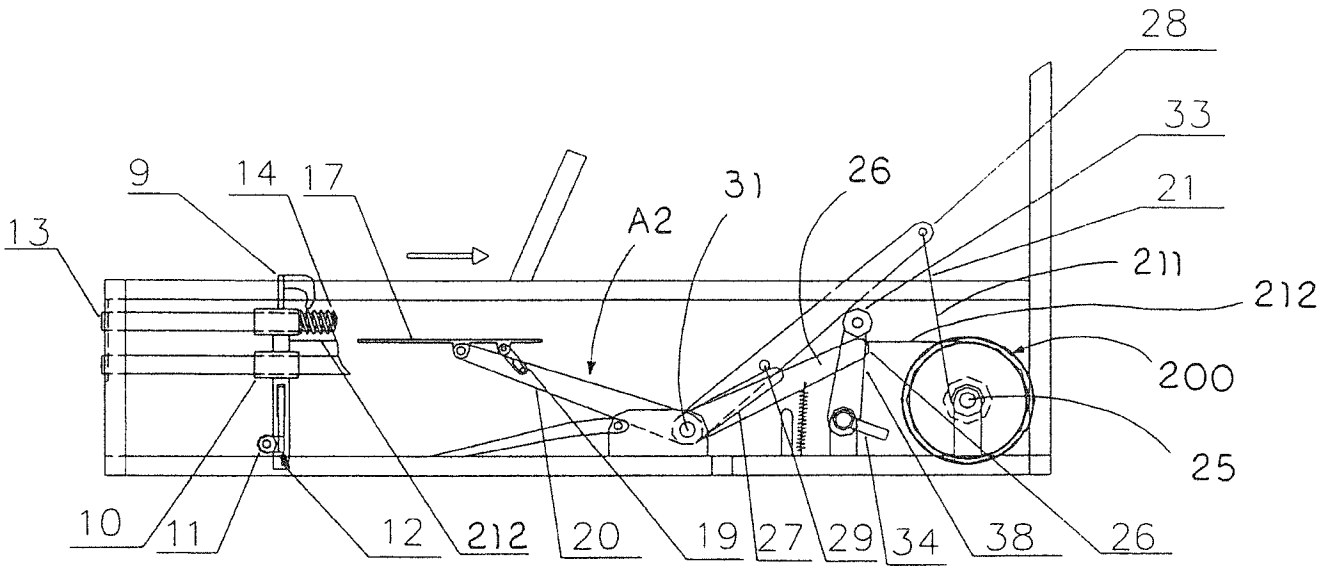
FIG. 6 is a schematic diagram of a working process of the automatic shoe cover dispenser according to the above preferred embodiment of the present invention, illustrating the original state of working process of the present invention.

A plurality of shoe covers 5 is previously placed at the feeding rod 2, wherein the shoe opening 6 of the shoe cover 5 faces to the active member 9. Then, install the position plate 4 to the feeding rod 2 to place and push on top of the stack of shoe covers 5. Following a downward movement of the pedal 17 when a force applied thereon, as shown in FIG. 6 of the drawings, the linkage arms 20, the draw arm 26 and the driving arm 27 displace accordingly at the same time. Then, the driving arm 27 drives the auxiliary arm 28 to move upwards through the linkage pin 29 so as to pull the first drag element 211 to drive the first and second roller wheels 23, 24 to rotate, wherein through the second drag element 212, the first roller wheel 23 drives the sliding members 10 to move towards fixed members 8 along the racks 13, so that the active members 9 follow the sliding members 10 to move simultaneously to compress the elastic members 14.

When the pedal 17 is continuously stepped down, the active members 9 continuously move towards the fixed members 8 and, at the same time, the sliding guides 15 will be lifted up to compress the reset units 12 while the clasping elements 91 of the active members 9 are driven to move towards each other to form a close-up condition, wherein when the active members 9 are moved to a position behind the fixed members 8, the active members 9 enter the shoe opening 6 of one of the shoe covers 5.

During the downward movement of the pedal 17 which is continuously stepped downwardly to a lowest position, the active members continuously move and drive the bearings 11 to move to the ends of the sliding guides 15 until departing from the control of the sliding guides 15. At this moment, bearings 11 are driven downwardly to return to their original position by means of the reset units 12 and thus driving the active members 9 to move apart from each other to form an open-up condition, in which since the clasping elements 91 of the active members 9 enter the respective shoe cover 5 through the shoe opening 6 at this moment, the clasping elements 91 of the active members 9 clasp against the elastic peripheral edge 61 of the shoe opening 6 and open up the shoe opening 6 while the active members 9 moving apart from each other, as shown in FIG. 7.

At this moment, since the pedal 17 is stepped to a lowest position, the auxiliary arm 28 is driven accordingly to a highest position, during the upward rotating movement of the auxiliary arm 28, the buffer arm 38 moves upwards simultaneously through the resilient element 36. When the auxiliary arm 28 is upwardly moved to the highest position, the buffer arm 38 moves, at the same time, to the banking block 37 while the buffer bearing 33 in contact with a lower side of the auxiliary arm 28, so that the buffer arm 38 presses against the auxiliary arm 28 so as to support the auxiliary arm 28 from moving downwards to its original position simultaneously when the downward force applied to the pedal 17 is released, as shown in FIG. 9.

After the stepping down process of the pedal 17 as described above is completed, lift up the user's foot which previously applied the downward force to the pedal 17, the downward force applied to the pedal 17 is released and the pedal 17 will moves upwards to its original upper position due to the spring action of the linkage resilient element 40. At the same time, the linkage arms 20, the draw bar 26 and the driving arm 27 start to rotate back to their original positions while the buffer bearing 38 pushing against the auxiliary arm 28 so as to support the auxiliary arm 28 from being rotated downwardly simultaneously. Thus, there is also no displacement for the first drag element 211 so that during the pedal 17 starts to be lifting up of the pedal 17 to its original position, the first and second roller wheels 23, 24 and the active members 9 will remain in their still condition. Therefore, the user may easily lift his or her foot from the pedal 17.

When the pedal 17 moves to its highest position, the draw bar 26 rotates downwardly to its lowest position and hits the buffer pin 34. Since the buffer pin 34 and the buffer arm 38 are affixed to the buffer shaft 35, the buffer pin 34 overcomes the pulling force of the resilient element 36 and rotates downwardly due to the impact of the draw bar 26 so that the contact condition between the auxiliary arm 28 and the buffer arm 38 and the buffer bearing 33 will change accordingly and return to their original condition. Also, the limitation of the auxiliary arm 28 by the buffer bearing 33 is released and the auxiliary arm 28 starts to rotate downwardly by means of the elastic members 14, as shown in FIG. 10. At the same time, the first and second roller wheels 23, 24 start to rotate to their original position simultaneously and the active members 9 starts to move backwards to their original position under the spring action of the elastic members 14.

At this moment, since the clasping elements 91 of the active members 9 are clasped with the elastic peripheral edge 61 of the shoe opening 6 of the respective shoe cover 5, the active members 9 will drive the elastic peripheral edge 61 of the shoe opening 6 of the shoe cover 5 to move backwards. During such motion, since the fixed members 8 are located at a middle portion of the elastic peripheral edge 61 of the shoe opening 6 when the shoe opening 6 is which is enlarged by the active members 9 in the open-up condition, the fixed members 8 will hook on the upper side of the elastic peripheral edge 61 of the shoe opening 6 so as to render the elastic peripheral edge 61 of the shoe opening 6 separates from the clasping of the clasping elements 91 of the active members 9 while the lower side of the elastic peripheral edge 61 of the shoe opening 6 remains clasping by the clasping elements 91 of the active members 9 to move backwards, so that the shoe opening 6 is pulled to open accordingly.

Moreover, the sliding guides 15 are movably mounted on the frame 1 by means of the sliding guide shafts 16 to provide a one-way guiding ability so that, during the backward movement of the active members 9, the bearings 11 will not be limited by the sliding guides 15. In order words, during the backward pulling and opening procedures of the shoe opening 6 as described above, the active members 9 is ensured to remain in the open-up condition under the spring effect of the reset units 12 until they are return to their original position, as shown in FIG. 8, and thus the shoe opening 6 is completely opened up.

Since the pedal 17 is positioned below the shoe cover 5 with its shoe opening being opened, when the user place and step on the pedal 17 again, the stepping down of the shoe cover 5 will drive the elastic peripheral edge 61 of the shoe opening 6 downwards to separate from the active members 9 and the fixed members 8 while the holding member 39 is pressed to separate from the feeding rod 2 at the same time. Thus the shoe cover 5 will wrap over the user's shoe stepped on the pedal 17 to complete the wearing process of the shoe cover 5. Also, in this stepping process, the repeated downward stepping actions of the pedal 17 will drive the active members 9, the linkage arms 20, draw arm 26, the driving arm 27, the auxiliary arm 28, the first and second roller wheels 23, 24, the first and second drag elements 211, 212, and the buffer arm 38 will process the above actions repeatedly so as to accomplish the wearing of the shoe cover 5 on the user's shoe repeatedly simply by stepping on the pedal 17.

Figure 11:
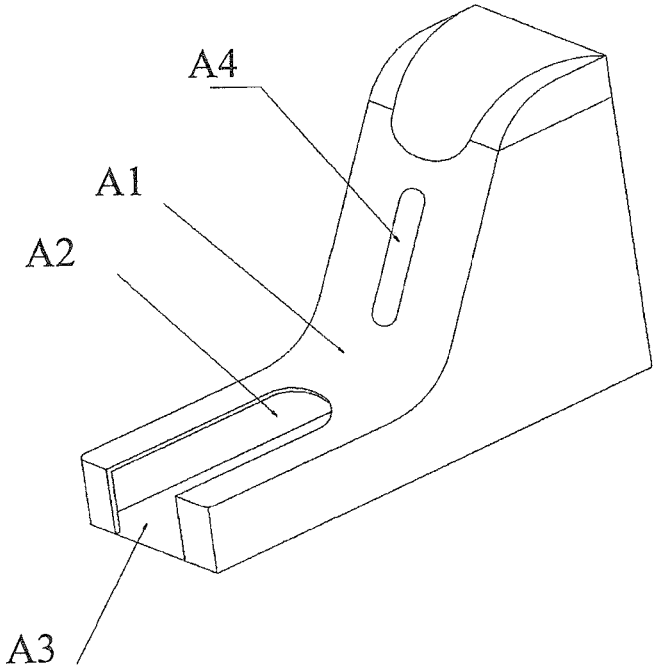
FIG. 11 is a schematic view of an automatic shoe cover dispenser according to a second preferred embodiment of the present invention, illustrating the vertical shoe cover dispenser structure.
Figure 12:
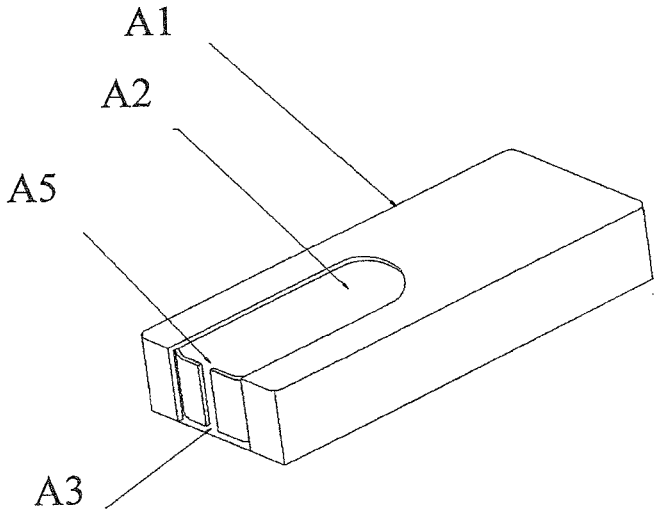
FIG. 12 illustrates an alternative of the automatic shoe cover dispenser according to the second preferred embodiment of the present invention, illustrating the horizontal shoe cover dispenser structure.

Referring to FIGS. 11 to 12 of the drawings, the automatic shoe cover dispenser according to a second embodiment is illustrated, wherein the automatic shoe cover dispenser can be configured as a vertical shoe cover dispenser structure as shown in FIG. 11, or as a horizontal shoe cover dispenser structure as shown in FIG. 12. Accordingly, the automatic shoe cover dispenser comprises a shoe cover feeding arrangement holding a plurality of shoe covers A11. The shoe cover feeding arrangement comprises a housing A1 defining an outlet A3 at a rear side thereof and a shoe disposing opening A2 communicating with the outlet A3, a pair of sliding tracks A7, a shoe cover pulling mechanism for pulling the shoe cover A11 into an open-up condition as a standby shoe cover and being ready for putting on a user's shoe and for enabling the shoe cover A11 being detached from the subsequent shoe cover A11 after the shoe cover A11 is worn. Accordingly, the shoe covers A11 are coupled in a sequent order and are folded to be stored in the housing A1. The housing A1 further has a transparent window A4, as shown in FIG. 12, enabling the user to view the condition of the shoe covers A11 within the interior of the housing A1 in order to reload the shoe covers A11 once all the shoe covers A11 are dispensed. A swing door A5 is provided at the outlet A3 to enclose the outlet A3.

According to the present invention, the shoe cover pulling mechanism comprises a retention unit to keep the shoe cover A11 in the open-up condition and a linked swinging arm A14 to separate the shoe cover A11 from the other shoe covers A11.

Figure 14:
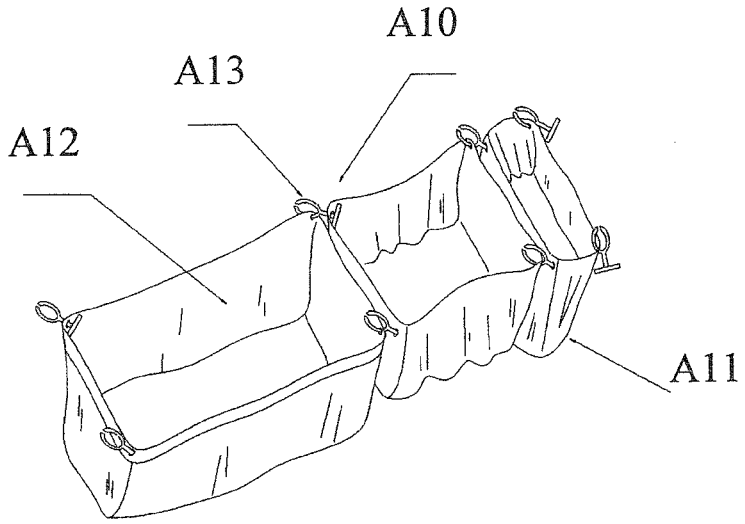
FIG. 14 is a perspective view of the shoe cover set of the automatic shoe cover dispenser according to the second preferred embodiment of the present invention.
Figure 16:
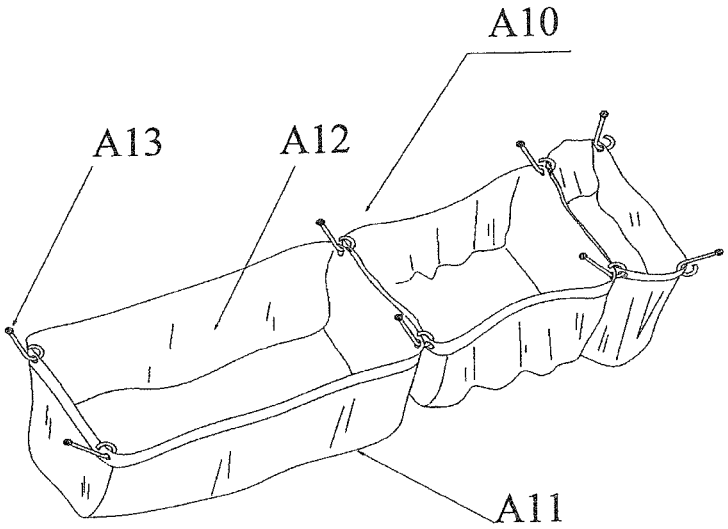
FIG. 16 is a perspective view of the shoe cover set of the automatic shoe cover dispenser according to the second preferred embodiment of the present invention, illustrating an alternative mode of the sliding joint.
Figure 18:
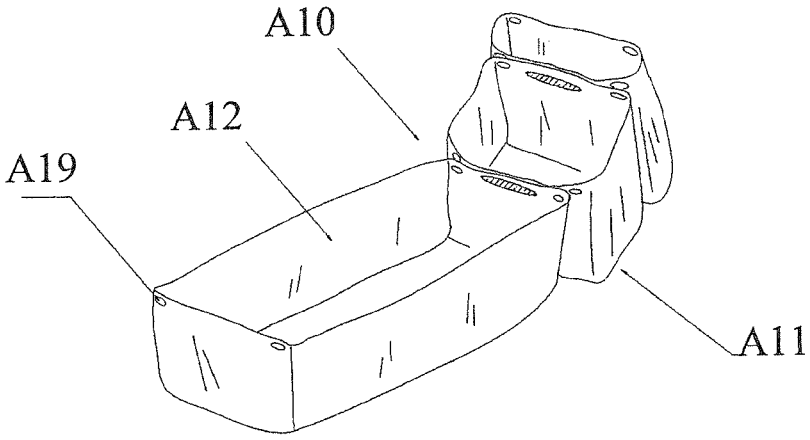
FIG. 18 is a perspective view of the shoe cover set of the automatic shoe cover dispenser according to the second preferred embodiment of the present invention, illustrating the shoe covers coupling with each other via adhesive.

The shoe disposing opening A2 is formed at the top side of the housing A1 for a foot of the user to stepping therethrough (as shown in FIGS. 11 and 12). The linked swinging arm A14 is rotatably hinged at the outlet A3. The sliding tracks A7 are provided at two sides of the housing A1 to define the shoe disposing opening A2 between the sliding tracks A7. In other words, the sliding tracks A7 are extended parallel to define the shoe disposing opening A2 therebetween, wherein the sliding tracks A7 are adapted for storing and feeding the shoe covers A11 in a sequent order, such that the shoe covers A11 are retained and slid along the sliding tracks A7. The retention unit comprises a first stopper A8 and a second stopper A9 which are provided at the front and rear ends of the shoe disposing opening A2 of the housing A1 respectively, as shown in FIG. 14, FIG. 16 and FIG. 18.

Accordingly, the shoe covers A11 are coupled with each other in a sequent manner to form a shoe cover set A10 stored in the housing A1, wherein each of the shoe covers A11 has a pocket 16 made of soft material and a shoe opening A12 which can be formed by encircling an elastic material such as elastic band around the rim of the shoe opening A12 to form an elastic peripheral edge around the shoe opening A12. The shoe covers A11 are folded and coupled with each other to form the shoe cover set A10. In other words, each of the shoe covers A11 foams a bag body that the shoe opening A12 of the shoe cover A11 is guided to align with the shoe disposing opening A2 between the sliding tracks A7.

Figure 34:
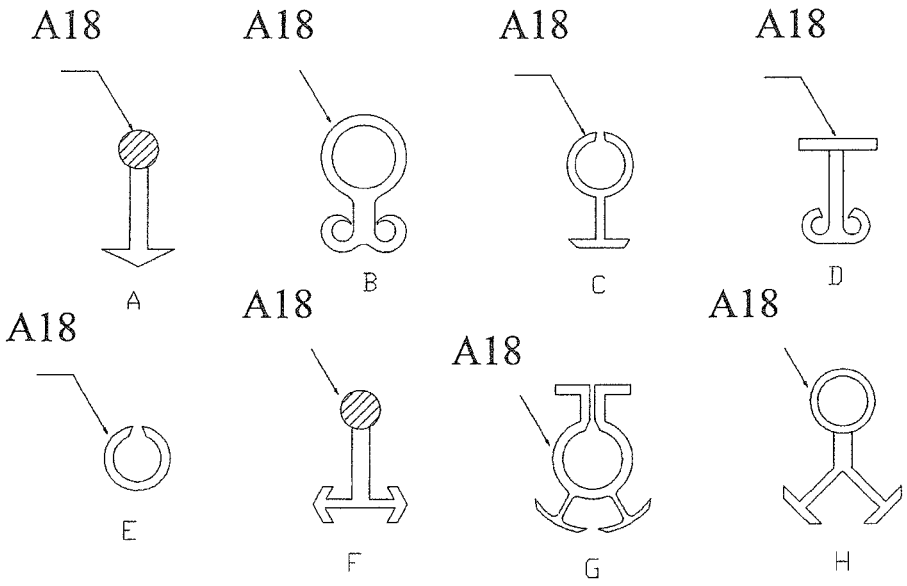
FIG. 34 illustrates different structural configurations of the sliding joint of the automatic shoe cover dispenser according to the second preferred embodiment of the present invention.

Each two adjacent shoe covers A11 are serial connected at the two corresponding corners of the shoe opening A12 so that the shoe covers A11 are overlappedly coupled and folded to form a one piece folding structure. In other words, each shoe cover A11 has the shoe opening A12 defining four corners, i.e. two front corners and two rear corners. The two rear corners of the shoe cover A11 are coupled to the two front corners of the subsequent shoe cover A11, and two front corners of the shoe cover A11 are coupled to the two rear corners of the former shoe cover A11. The shoe covers A11 are coupled via the sliding joints A13 to couple with the sliding tracks A7. In other words, the sliding joint A13 are provided between the corners of the shoe cover A11 to couple with the corresponding corners of the shoe cover A11. Each two sliding joints A13 are connected at the two rear corners of the standby shoe cover A11 and the two front corners of the subsequent shoe cover A11. Each sliding joint A13 comprises a sliding element to slidably couple with the sliding track A7 so that after each sliding joint A13 engages with the sliding track A7, the shoe cover set A10 is retained along the sliding tracks A7. Each sliding joint A13 has a guiding portion having a closed cycle shape, semi-closed cycle shape, "T" shape, or ball shape with hook, etc, as shown in FIG. 34. Each sliding joint A13 can be a retaining hole A19 formed at the pocket 16 of the shoe cover A11 to slidably engage with the sliding track A7. The shoe covers A11 can also be coupled via adhesive, temporary sewing or the like to form the shoe cover set A10, as shown in FIGS. 14, 16, 18 and 20.

According to the preferred embodiment, the shoe disposing opening A2 of the housing A1 is an open area formed on the top side of the housing A1 for the foot (shoe) of the user to place therethrough and for the foot of the user rearwardly sliding out at the outlet A3 at the rear side of the housing A1. The swing door A5 is provided at the outlet A3 to enclose the outlet A3, as shown in FIG. 12. Alternatively, the outlet A3 can also be an open area formed at the rear side of the housing A1, as shown in FIG. 11. The sliding tracks A7 and the retention unit can be directly received in the housing A1. Or, the housing A1 can have a casing and a frame A6 received therein, wherein the sliding tracks A7 and the retention unit are formed at the frame A6, as shown in FIGS. 11, 12, 13, 15*a*, and 15*b*.

Figure 13:
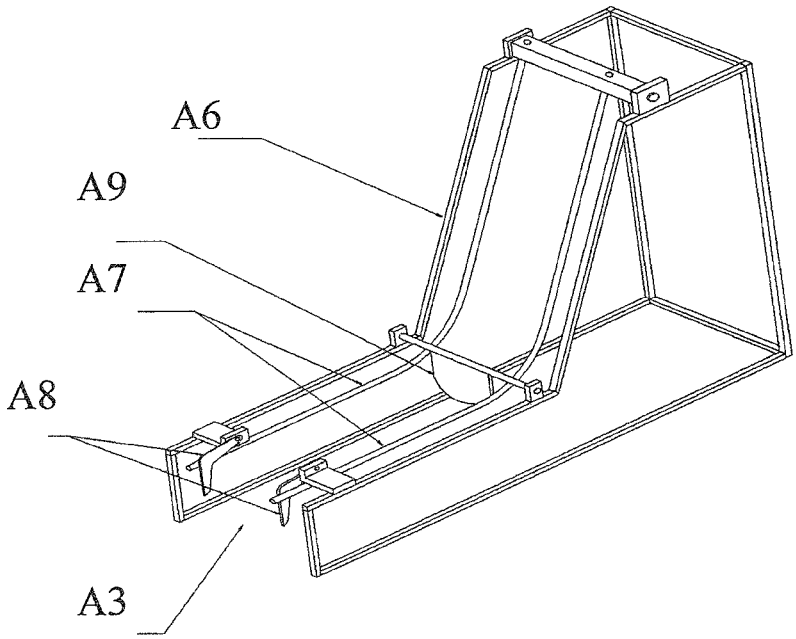
FIG. 13 is a perspective view of the shoe cover pulling mechanism of the automatic shoe cover dispenser according to the second preferred embodiment of the present invention.
Figure 15A:
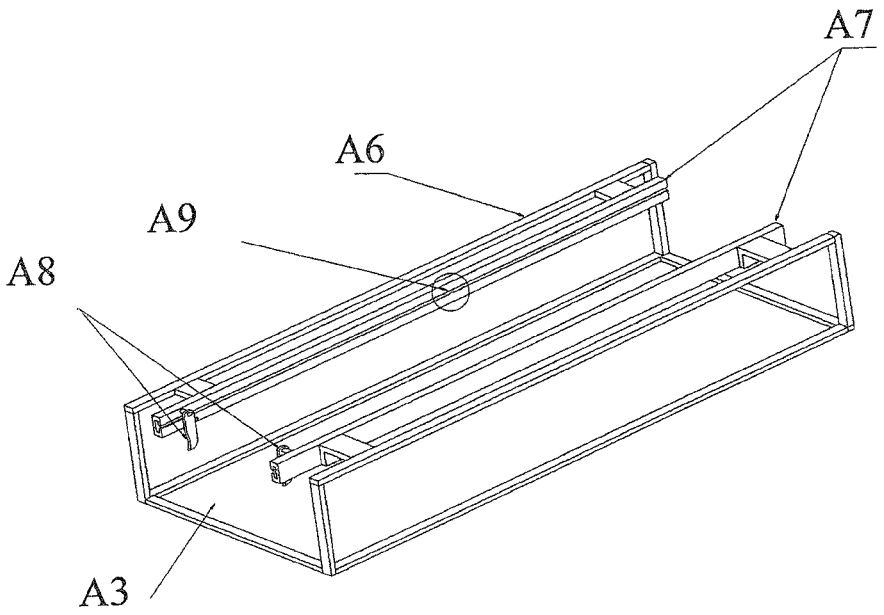
FIG. 15*a* is a perspective view of the sliding tracks of the automatic shoe cover dispenser according to the second preferred embodiment of the present invention, illustrating the horizontal shoe cover dispenser structure.
Figure 15B:
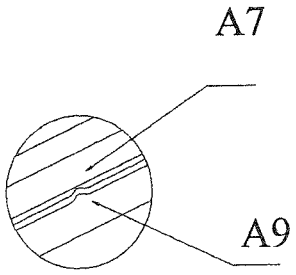
FIG. 15*b* illustrates the second stopper formed at the sliding track of the automatic shoe cover dispenser according to the second preferred embodiment of the present invention.
Figure 17A:
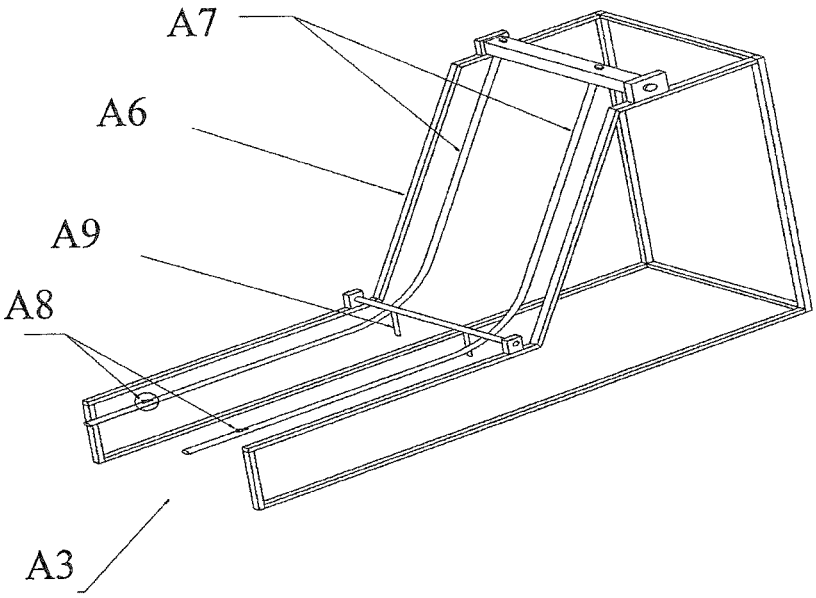
FIG. 17*a* is a perspective view of the sliding tracks of the automatic shoe cover dispenser according to the second preferred embodiment of the present invention, illustrating the vertical shoe cover dispenser structure.
Figure 17B:
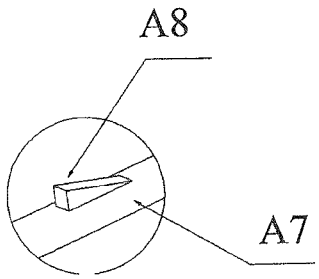
FIG. 17*b* illustrates an alternative mode of the first stopper formed at the sliding track of the automatic shoe cover dispenser according to the second preferred embodiment of the present invention.
Figure 19A:
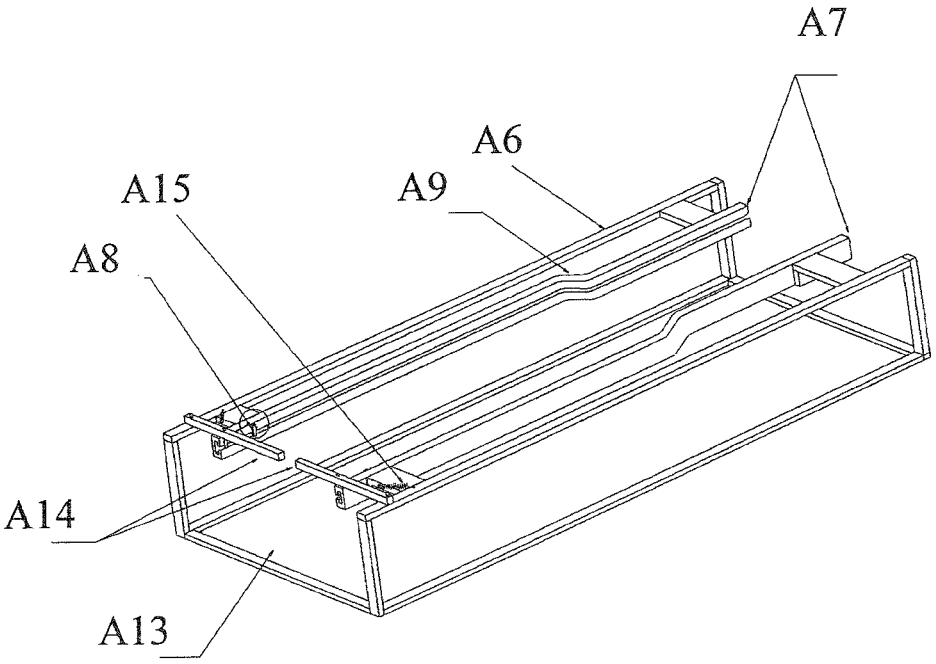
FIGS. 19*a* and 19*b* illustrates another alternative mode of the first and second stoppers of the automatic shoe cover dispenser according to the second preferred embodiment of the present invention.
Figure 19B:
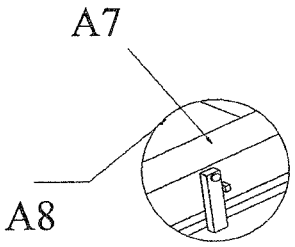
Figure 20:
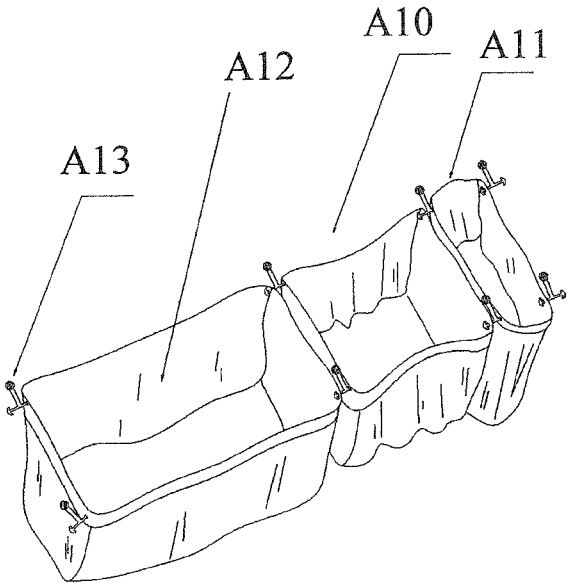
FIG. 20 is a perspective view of the shoe cover set of the automatic shoe cover dispenser according to the second preferred embodiment of the present invention, illustrating another alternative mode of the sliding joints.
Figure 21:
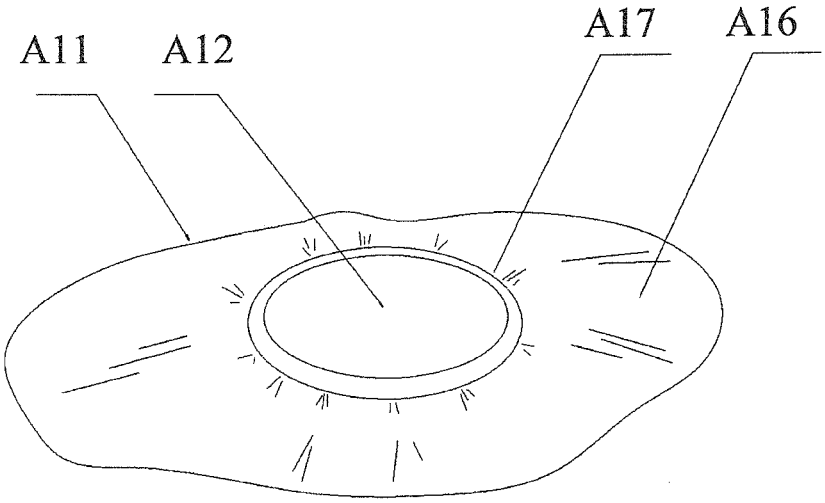
FIG. 21 is a perspective view of the shoe cover of the automatic shoe cover dispenser according to the second preferred embodiment of the present invention.

According to the present invention, each of the first stopper A8 and the second stopper A9, preferably having a L-shaped configuration, is pivotally hinged in the housing A1 (as shown in FIGS. 13, 19*a* and 19*b*), or is a flexible panel provided in the housing A1 (as shown in FIGS. 13, 17*a*, and 17*b*) that the flexible panel applies a resilient force to stop the sliding movement of the sliding joint A13. Or, each of the first and second stoppers A8, A9 can be a protrusion protruded at the respective sliding track A7, as shown in FIGS. 15*a*, 15*b*, 17*a*, and 17*b*. Likewise, each of the sliding tracks A7 can be bent to define a curving portion to form the corresponding first and second stoppers A8, A9, as shown in FIGS. 15*a*, 15*b*, 19*a*, and 19*b*. The first and second stoppers A8, A9 are provided at front and rear ends of the shoe disposing opening A2 of the housing A1 as shown in FIG. 13. Or, the first and second stoppers A8, A9 can be formed at the sliding tracks A7 at a position that the first and second stoppers A8, A9 are provided at front and rear ends of the shoe disposing opening A2 of the housing A1 as shown in FIGS. 15*a* and 15*b*.

Accordingly, each of the first and second stoppers A8, A9 is moved between an idle position and a moving position. At the idle position, the first and second stoppers A8, A9 engage with the front and rear sides of the standby shoe cover A11 to enlarge the shoe opening A12 of the standby shoe cover A11 for retaining the shoe cover A11 at the open-in position so as to align with the shoe disposing opening A2 of the housing A1 when the corresponding shoe cover A11 is slid at the shoe disposing opening A2 of the housing A1. At the moving position, the first and second stoppers A8, A9 disengage with the front and rear sides of the standby shoe cover A11 for enabling the standby shoe cover A11 being pulled out of the outlet A3. At the same time, the subsequent shoe cover A11 can be slid to the shoe disposing opening A2 at a position that the rear side of the subsequent shoe cover A11 is stopped by the first stopper A8 when the first stopper A8 is returned back to the idle position via a resilient force. Accordingly, the front side of the subsequent shoe cover A11 is stopped by the second stopper A9 when the second stopper A9 is returned back to the idle position via a resilient force. When the first and second stoppers A8, A9 return back to the idle position, the first and second stoppers A8, A9 engage with the front and rear sides of the subsequent shoe cover A11 to retain the subsequent shoe cover at the open-up position. Therefore, the subsequent shoe cover A11 will be retained at the open-up position via the first and second stoppers A8, A9 once the former shoe cover A11 is slid out of the outlet A3.

Each of the first stopper A8 and the second stopper A9 can be a blocking panel made of resilient material that the resilient force thereof is strong enough to overcome the contraction force of the shoe opening A12 of the shoe cover A11 itself so that the shoe cover A11 is able to retain in the open-up position.

According to the present invention, each of the sliding tracks A7 is a guiding shaft or a guiding rail having an elongated sliding slot, the structure is selected to couple with the structure of the sliding joints A13 (as shown in FIGS. 13, 15*a* and 15*b*). Alternatively, the housing A1 comprises an outer casing wherein the sliding tracks A7, the retention unit and the linked swinging arms are provided therein. Or, the housing A1 comprises an outer casing wherein the frame A6 is disposed in the outer casing. The frame A6 has an opening corresponding to the outlet A3 at the shoe disposing opening A2 of the outer casing of the housing A1, the sliding tracks A7, the retention unit and the linked swinging arm A14 can be mounted on the frame A6, wherein the frame A6 can have a vertical type structure or a horizontal structure.

The linked swinging arm A14 can be two pivotal doors provided at the two sidewalls of the outlet A3 respectively, or just a single pivotal door provided at the outlet A3 with a restoring spring A15.

Referring to FIGS. 13, 14, 22, 23, and 24 of the drawings, the shoe covers A11 are coupled orderly to form the shoe cover set A10 via the sliding joints A13, wherein the shoe cover set A10 is slidably received in the housing A1 through the sliding tracks A7. Accordingly, the shoe covers A11 are one-by-one coupled orderly to form the shoe cover set A10 via the sliding joints A13 with the T-shaped connecting portions, as shown in FIG. 14. In addition, the resilient openings 12 of the shoe covers A11 are facing upward.

Each of the sliding tracks A7 can be a shaft and defines an elongated portion at the front side of the first stopper A8. Each of the sliding joints A13 can have a loop for the corresponding sliding track A7 to pass through so that the shoe cover set A10 is slidably retained between the sliding tracks A7 via the sliding joints A13.

Figure 22:
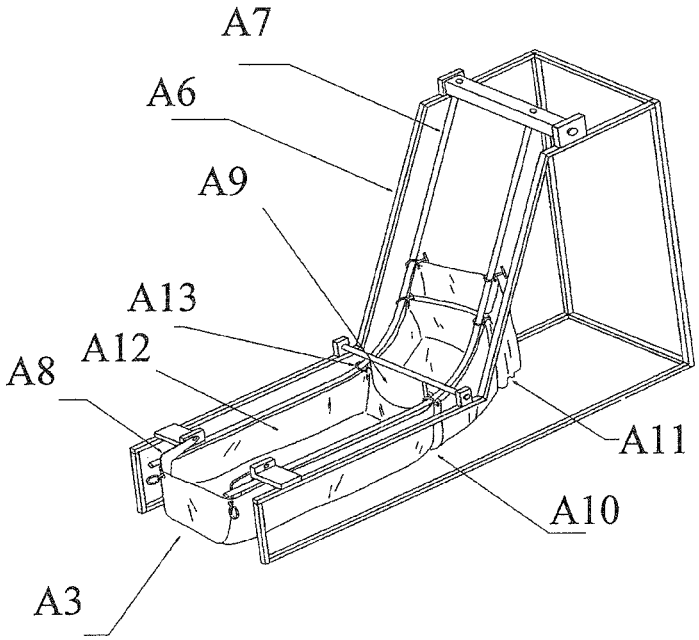
FIG. 22 is a perspective view of the automatic shoe cover dispenser according to the second preferred embodiment of the present invention, illustrating the standby shoe cover at the open-up condition.

In order to operate the automatic shoe cover dispenser, the standby shoe cover A11 of the shoe cover set A10 is slidably pulled along the sliding tracks A7 at the shoe disposing opening A2 of the housing A1 at a position that the shoe opening A12 of the standby shoe cover A11 is opened up and is aligned with the shoe disposing opening A2. Accordingly, when the standby shoe cover A11 is slidably pulled, the sliding joints A13 at the front corners of the standby shoe cover A11 are stopped by the first stopper A8 while the sliding joints A13 at the rear corners of the standby shoe cover A11 are stopped by the second stopper A9 to retain the standby shoe cover A11 at the open-up position, as shown in FIG. 22.

The user is able to place the foot at the shoe cover A11 through the shoe opening A12 thereof. Then, by applying a horizontal pulling force towards the outlet A3 at a direction parallel to the sliding tracks A7, the shoe cover A11 is pulled towards the outlet A3 until the foot of the user slides out of the housing A1 through the outlet A3 thereof. At the same time, the two sliding joints A13 at the rear side of the standby shoe cover A11 are slidably moving towards the outlet A3.

Figure 23:
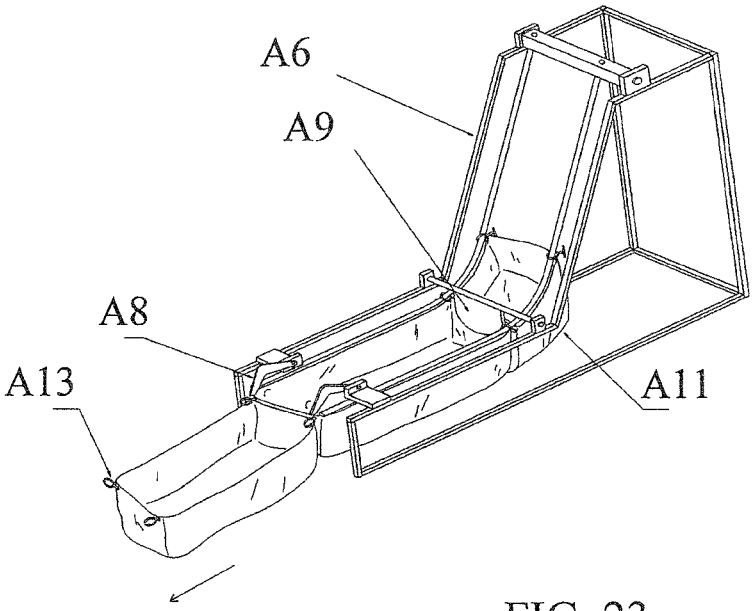
FIG. 23 is a perspective view of the automatic shoe cover dispenser according to the second preferred embodiment of the present invention, illustrating the standby shoe cover being slid out of the outlet.
Figure 24:
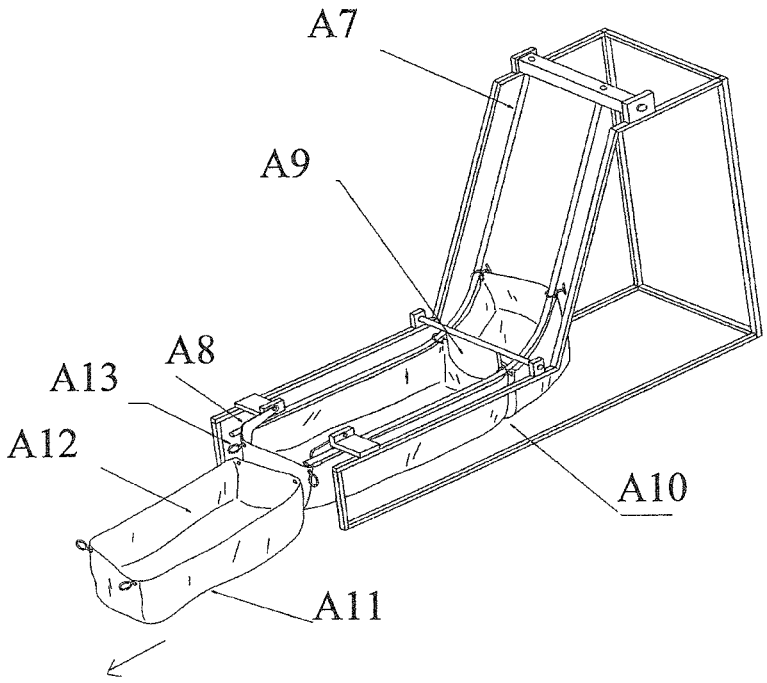
FIG. 24 is a perspective view of the automatic shoe cover dispenser according to the second preferred embodiment of the present invention, illustrating the standby shoe cover being slid out of the outlet and the alternative mode of the first and second stoppers.
Figure 25:
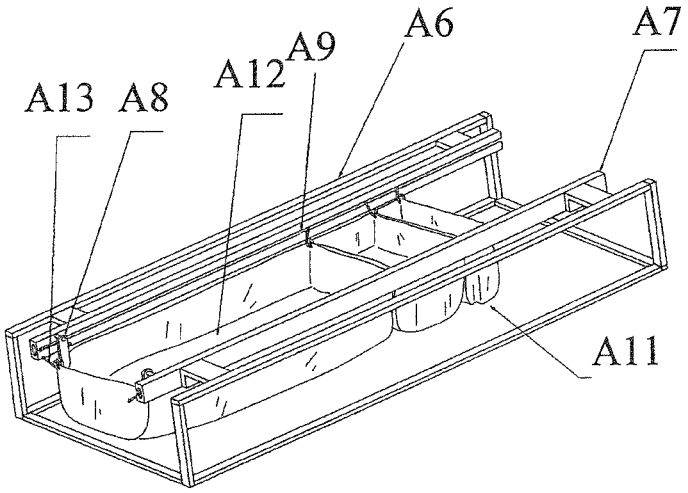
FIG. 25 is a perspective view of the automatic shoe cover dispenser according to the second preferred embodiment of the present invention, illustrating the first and second stoppers retaining the standby shoe cover at the open-up condition within the horizontal shoe cover dispenser structure.
Figure 26:
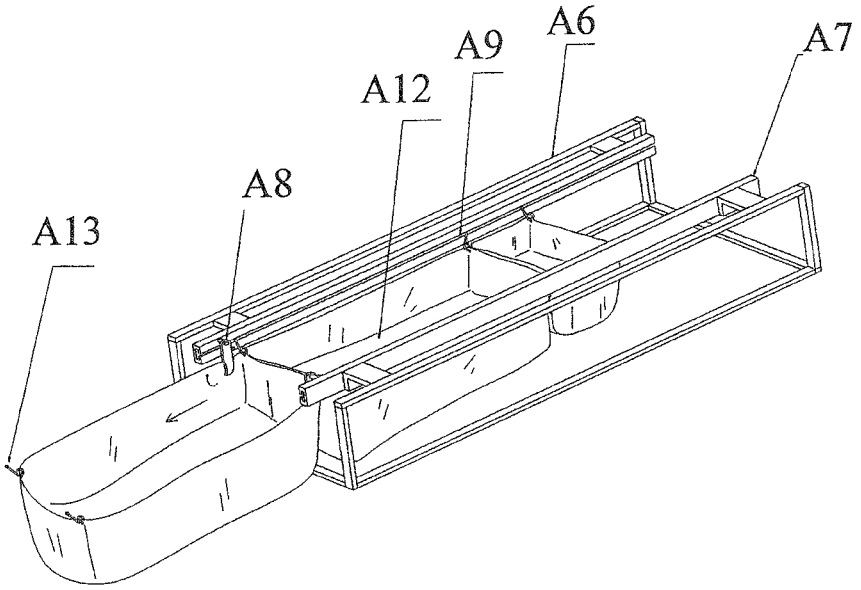
FIG. 26 is a perspective view of the automatic shoe cover dispenser according to the second preferred embodiment of the present invention, illustrating the first and second stoppers at the moving position for the standby shoe cover being slid out of the outlet at the horizontal shoe cover dispenser structure.
Figure 27:
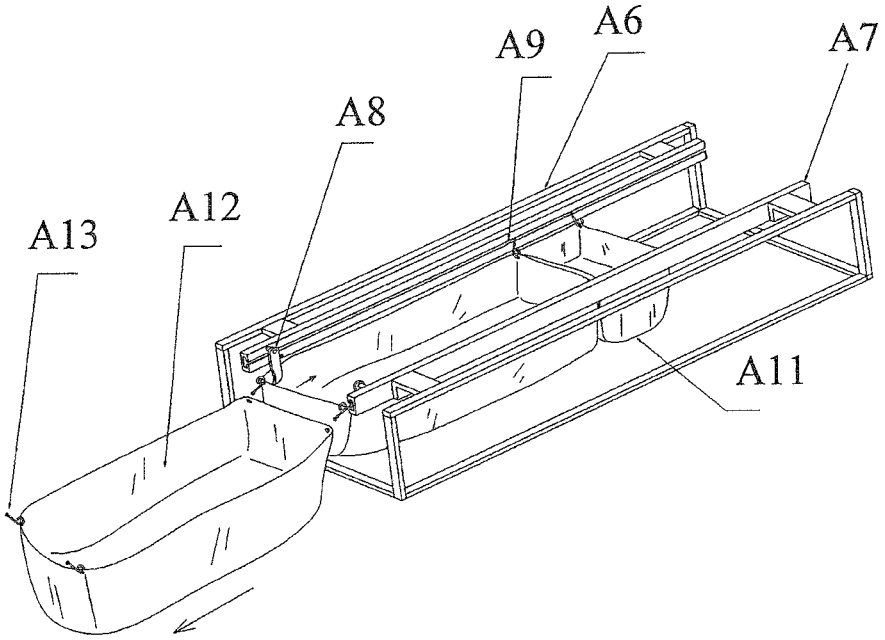
FIG. 27 is a perspective view of the automatic shoe cover dispenser according to the second preferred embodiment of the present invention, illustrating the first and second stoppers moving back to the idle position to retain the subsequent shoe cover at the open-up condition within the horizontal shoe cover dispenser structure.

Due to the pulling force, the sliding joints A13 will detach from the sliding tracks A7 at the outlet A3. At the same time, the sliding joints A13 at the front corners of the standby shoe cover A11 will be slidably to overcome the blocking ability of the second stopper A9. Since the subsequent shoe cover A11 is coupled with the standby shoe cover A11 via the sliding joints A13 by coupling the front corners of the standby shoe cover A11 with the rear corners of the subsequent shoe cover A11, the sliding joints A13 at the rear corners of the subsequent shoe cover A11 will also be slidably to overcome the blocking ability of the second stopper A9 at the same time when the standby shoe cover A11 is pulled, as shown in FIG. 23. Therefore, the subsequent shoe cover A11 will be pulled at the shoe opening A12. When the foot of the user keeps moving out of the outlet A3, the first stopper A8 will pivotally swing back to the original position. Therefore, the first stopper A8 will contact with the sliding tracks A7 to form a block for blocking the subsequent sliding joints A13 sliding out of the sliding tracks A7. When the foot of the user slides out of the outlet A3, the sliding joints A13 at the front corners of the standby shoe cover A11 is stopped by the first stopper A8. In other words, the sliding joints A13 at the rear corners of the subsequent shoe cover A11 is stopped by the first stopper A8, such that the sliding joints A13 at the front corners of the subsequent shoe cover A11 will be stopped by the second stopper A9. Accordingly, the sliding joints A13 at the front corners of the subsequent shoe cover A11 cannot overcome the blocking ability of the second stopper A9 because the sliding joints A13 at the rear corners of the subsequent shoe cover A11 is stopped by the first stopper A8. Meanwhile, the standby shoe cover A11 is detached from the subsequent shoe cover A11 by means of detaching from the T-shaped portion of the sliding joint A13. In other words, the standby shoe cover A11 is detached from the shoe cover set A10. The shoe opening A12 of the standby shoe cover A11 will be automatically contracted to wrap the standby shoe cover A11 around the shoe of the user. It is worth mentioning that after the standby shoe cover A11 is detached from the shoe cover set A10, the subsequent shoe cover A11 is slidably pulled along the sliding tracks A7 at the shoe disposing opening A2 of the housing A1 at a position that the shoe opening A12 of the subsequent shoe cover A11 is aligned with the shoe disposing opening A2 to retain the subsequent shoe cover A11 at the open-up position. In other words, the rear and front corners of the subsequent shoe cover A11 will be retained at the first and second stoppers A8, A9 respectively. Therefore, the subsequent shoe cover A11 is in an open state ready for use. By repeating the above procedure, the automatic shoe cover dispenser can repeatedly provide the shoe covers A11 in an automatic hand-free manner.

FIGS. 15*a*, 15*b*, 16, 25, 26, and 27 of the drawings illustrates an alternative mode the automatic shoe cover dispenser, wherein the automatic shoe cover dispenser has a similar structure and similar operating procedure as the automatic shoe cover dispenser as it is mentioned above, except the following differences: (1) the sliding joint A13 of the retention unit is a ball-shaped sliding element A18 to couple with the shoe cover A11 to form the shoe cover set A10, wherein the ball-shaped sliding element A18 of the sliding joint A13 can slidably couple with the respective sliding track A7; (2) each of the sliding tracks A7 has a corresponding elongated indented track structure for the ball-shaped sliding element 18 of the sliding joint A13 sliding therealong; (3) the first stopper A8 is pivotally coupled with the respective sliding track A7 and is a single pivot element, wherein the second stopper A9 is integrally formed at the respective sliding track A7 by bending the sliding track A7 with a protruded curving portion such that the blocking ability of the second stopper A9 is achieved by regulating the distance between the sliding tracks A7 at the second stoppers A9 and by the resilient force of the shoe cover A11 at the protruded curving portion of the sliding tracks A7, wherein the second stopper A9 is coupled at the rim of the shoe opening A12 of each of the shoe covers A11 as in the above embodiment, while the second stopper A9 is coupled at the sliding joint A13 as in this alternative; (4) the housing A1 and the frame A6 have a horizontal type structure.

Figure 28:
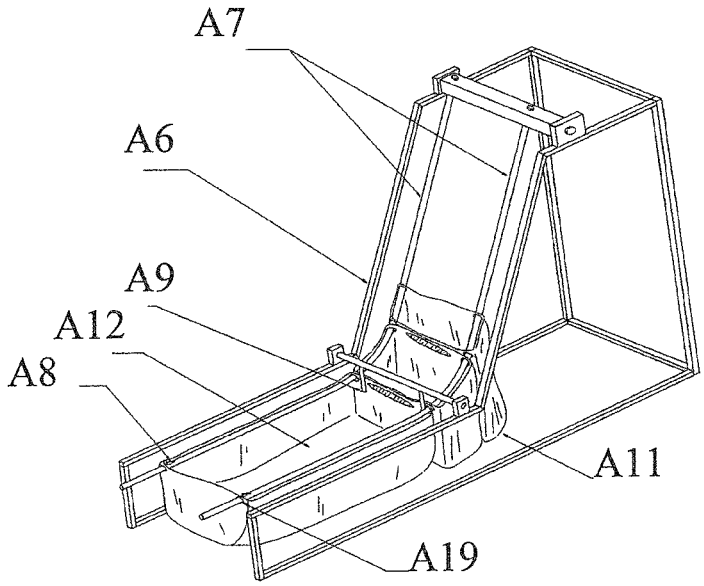
FIG. 28 is a perspective view of the automatic shoe cover dispenser according to the second preferred embodiment of the present invention, illustrating the first and second stoppers retaining the standby shoe cover at the open-up condition within the vertical shoe cover dispenser structure.
Figure 29:
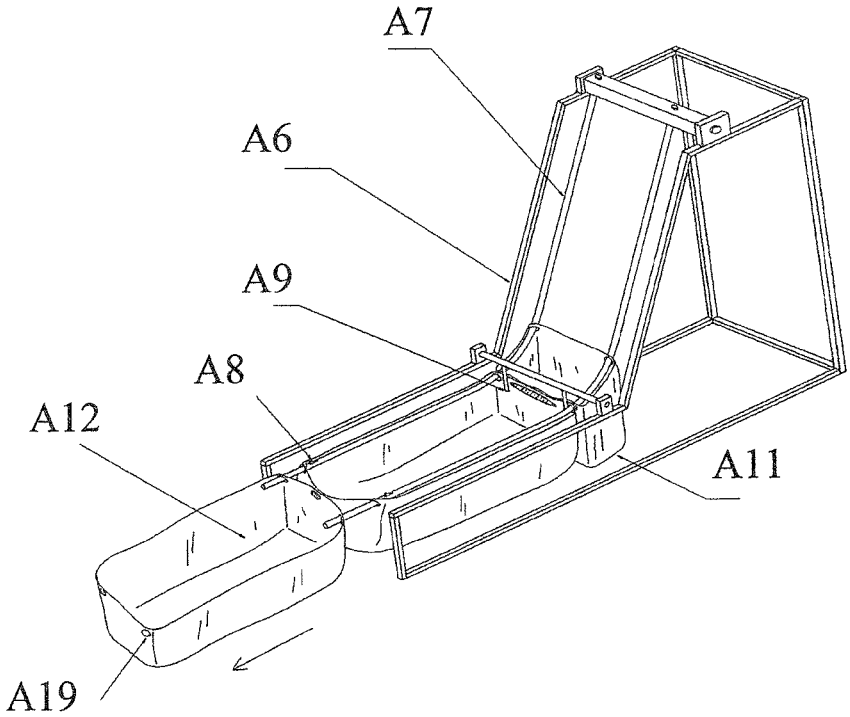
FIG. 29 is a perspective view of the automatic shoe cover dispenser according to the second preferred embodiment of the present invention, illustrating the first and second stoppers at the moving position for the standby shoe cover being slid out of the outlet at the vertical shoe cover dispenser structure.
Figure 30:
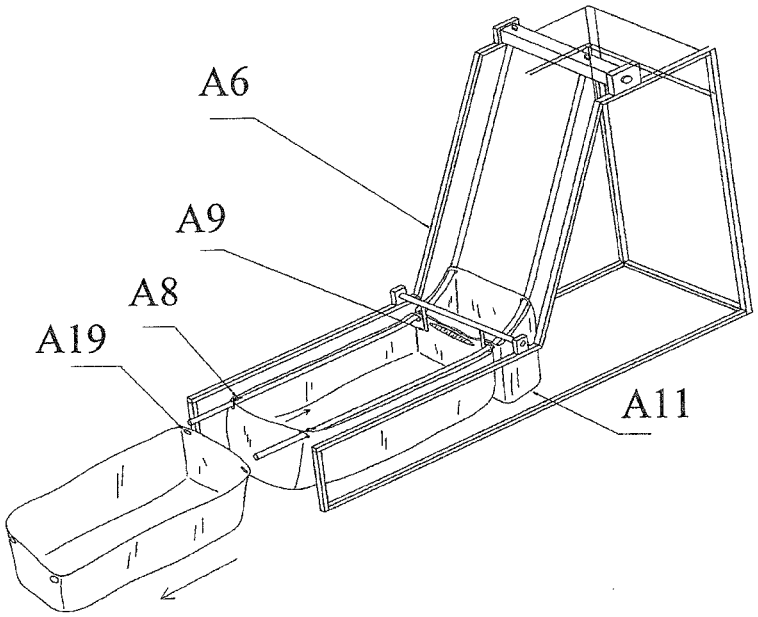
FIG. 30 is a perspective view of the automatic shoe cover dispenser according to the second preferred embodiment of the present invention, illustrating the first and second stoppers moving back to the idle position to retain the subsequent shoe cover at the open-up condition within the vertical shoe cover dispenser structure.

FIGS. 17*a*, 17*b*, 18, 28, 29, and 30 of the drawings illustrates an alternative mode the automatic shoe cover dispenser, wherein the automatic shoe cover dispenser has a similar structure and similar operating procedure as the automatic shoe cover dispenser as it is mentioned above, except that each sliding joint A13 is a retaining hole A19. The retaining holes A19 of two adjacent shoe covers A11 are couple with the sliding track A7, wherein the front portion of the former shoe cover A11 is coupled to the rear portion of the subsequent shoe cover A11. The first stopper A8 is integrally formed at the respective sliding track A7 by bending the sliding track A7 with a protruded curving portion, wherein the standby shoe cover A11 is slidably pulled until the retaining hole A19 at the rear side of the standby shoe cover A11 passes the first stopper A8 so as to retain the standby shoe cover A11 in position by the first stopper A8. In addition, the cross sectional area of the first stopper A8 is larger than the outer diameter of the retaining hole A19 of the sliding joint A13. The front side of the standby shoe cover A11 is stopped by the second stopper A9 which is embodied as a resilient panel as shown in FIG. 28. The resilient force of the second stopper A9 is larger than the contraction elastic force of the shoe opening A12 of the standby shoe cover A11 and the coupling force between the first and subsequent shoe covers A11 so that the standby shoe cover A11 is retained at the open-up position without detaching from the subsequent shoe cover A11. The difference between this alternative and the preferred embodiment is that the two adjacent shoe covers A11 are not coupled with each other by the sliding joint A13 but are coupled with each other by adhesive. Therefore, the sliding movement of the subsequent shoe cover A11 is not driven by the sliding joints A13 but is driven by the standby shoe cover A11 via the adhesive between the first and the subsequent shoe covers A11. Therefore, the retaining holes A19 at the subsequent shoe cover A11 are remained slidably coupling with the sliding tracks A7 when the standby shoe cover A11 is detached from the subsequent shoe cover A11, as shown in FIG. 29. When the standby shoe cover A11 is kept pulling out towards the outlet A3 by the foot of the user, the pulling force of the standby shoe cover A11 will overcome the adhesive force between the first and the subsequent shoe covers A11 such that the standby shoe cover A11 will detach from the subsequent shoe cover A11. Since the retaining holes A19 of the subsequent shoe cover A11 are remained to couple with the sliding tracks A7, the rear side of the subsequent shoe cover A11 will be bounded back to engage with the first stopper A8 at the time when the standby shoe cover A11 is detached from the subsequent shoe cover A11. Since the resilient force of the shoe opening A12 of the subsequent shoe cover A11 cannot overcome the blocking ability of the second stopper A9, the front side of the subsequent shoe cover A11 is stopped by the second stopper A9. Therefore, the subsequent shoe cover A11 will be retained at the open-up position via the first and second stoppers A8, A9 when the standby shoe cover A11 is dispensed.

Figure 31:
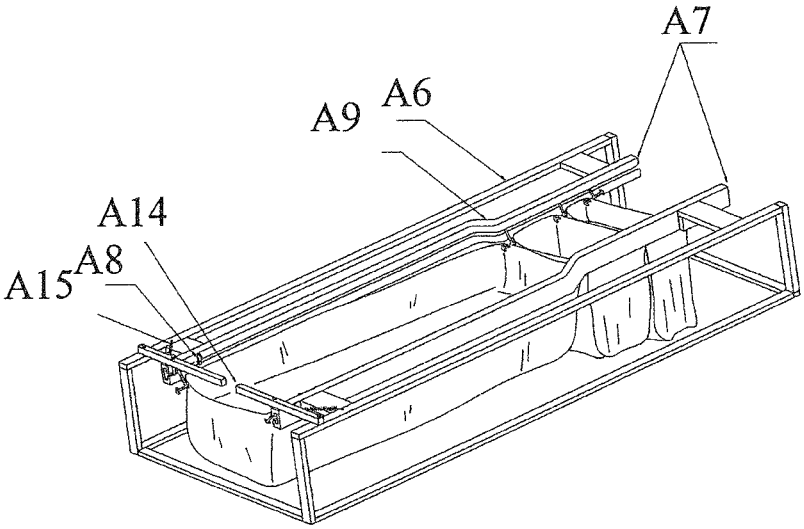
FIG. 31 is a perspective view of the automatic shoe cover dispenser according to the second preferred embodiment of the present invention, illustrating the linked swinging arms at the outlet.
Figure 32:
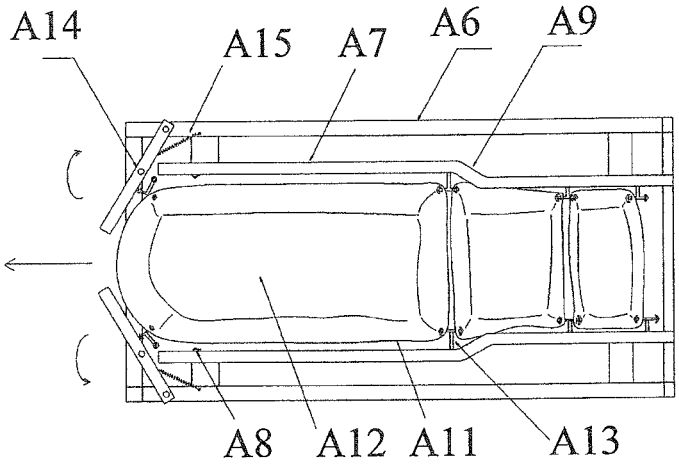
FIG. 32 is a top view of the automatic shoe cover dispenser according to the second preferred embodiment of the present invention, illustrating the linked swinging arms pivotally folding out of the outlet.
Figure 33:
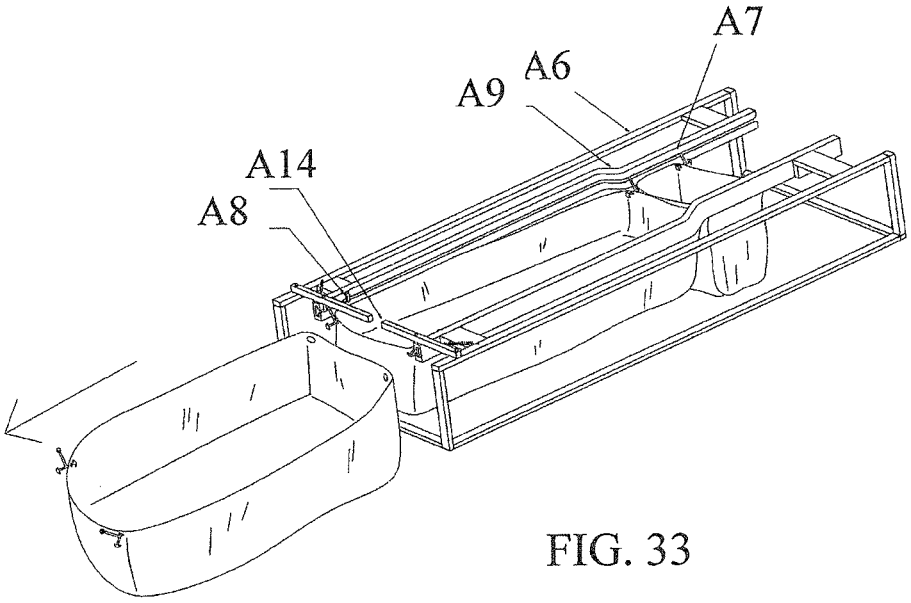
FIG. 33 is a perspective view of the automatic shoe cover dispenser according to the second preferred embodiment of the present invention, illustrating the linked swinging arms pivotally folding back to the outlet after the standby shoe cover is dispensed.

FIGS. 19*a*, 19*b*, 20, 31, 32, and 33 of the drawings illustrates an alternative mode the automatic shoe cover dispenser, wherein each of the sliding joints A13 has a T-shaped configuration with a ball shaped end portion to slidably engage with the sliding track A7. The standby shoe cover A11 of the shoe cover set A10 is slidably pulled along the sliding tracks A7 at the shoe disposing opening A2 of the housing A1 at a position that the shoe opening A12 of the standby shoe cover A11 is aligned with the shoe disposing opening A2. The first stopper A8 is a single pivot member while the second stopper A9 is integrally formed at the respective sliding track A7 by bending the sliding track A7 with a protruded curving portion. Accordingly, the standby shoe cover A11 is pulled until the rear side of the standby shoe cover A11 is stopped by the first stopper A8 while the front side of the standby shoe cover A11 is stopped by the second stopper A9. Since the second stopper A9 is the protruded curving portion of the sliding track A7, the sliding movement of the front side of the standby shoe cover A11 is blocked at the second stopper A9 by outwardly pulling the sliding joint A13 at the protruded curving portion and by the friction between the sliding track A7 and the sliding joint A13. Therefore, the standby shoe cover A11 is retained at the open-up position as shown in FIG. 31.

The user is able to place the foot at the standby shoe cover A11 through the shoe opening A12 thereof. Then, by applying a pulling force towards the outlet A3 at a direction parallel to the sliding tracks A7, the standby shoe cover A11 is pulled towards the outlet A3 until the foot of the user slides out of the housing A1 through the outlet A3 thereof. At the same time, the two sliding joints A13 at the rear side of the standby shoe cover A11 are slidably moving towards the linked swinging arm A14 to overcome the blocking ability of the first stopper A8. The linked swinging arm A14 will outwardly and pivotally fold towards the outside after being touched by the rear portion of the foot when pulling the foot out of the outlet A3 of the frame A6, such that the linked swinging arm A14 will move away from the sliding tracks A7.

When the foot of the user slides out of the outlet A3, the sliding joints A13 at the front corners of the standby shoe cover A11 is stopped by the first stopper A8 and blocked by the linked swinging arm A14. In other words, the sliding joints A13 at the rear corners of the subsequent shoe cover A11 is stopped by the first stopper A8 and blocked by the linked swinging arm A14 to open up the shoe opening A12 of the subsequent shoe cover A11, such that the sliding joints A13 at the front corners of the subsequent shoe cover A11 will be stopped by the second stopper A9. Accordingly, the sliding joints A13 at the front corners of the subsequent shoe cover A11 cannot overcome the blocking ability of the second stopper A9 because the sliding joints A13 at the rear corners of the subsequent shoe cover A11 is stopped by the first stopper A8. Meanwhile, the standby shoe cover A11 is detached from the subsequent shoe cover A11 by means of detaching from the T-shaped portion of the sliding joint A13 while the sliding joints A13 is blocked by the linked swinging arms A14. In other words, the standby shoe cover A11 is detached from the shoe cover set A10. The shoe opening A12 of the standby shoe cover A11 will be automatically contracted to wrap the standby shoe cover A11 around the shoe of the user. It is worth mentioning that after the standby shoe cover A11 is detached from the shoe cover set A10, the subsequent shoe cover A11 is slidably pulled along the sliding tracks A7 at the shoe disposing opening A2 of the housing A1 at a position that the shoe opening A12 of the standby shoe cover A11 is aligned with the shoe disposing opening A2 to retain the subsequent shoe cover A11 at the open-up position. In other words, the rear and front corners of the subsequent shoe cover A11 will be retained at the first and second stoppers A8, A9 respectively. Therefore, the subsequent shoe cover A11 is in an open state ready for use. By repeating the above procedure, the automatic shoe cover dispenser can repeatedly provide the shoe covers A11 in an automatic hand-free manner.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic shoe cover dispenser, comprising:

a shoe cover feeding arrangement, which comprises a housing having a shoe disposing opening, for holding a plurality of shoe covers, each having a shoe opening, being folded and orderly coupled with each other; and a shoe cover pulling mechanism for pulling one of said shoe covers into an open-up condition as a standby shoe cover and for consequently pulling a subsequent shoe cover by said standby shoe cover after said standby shoe cover is dispensed, wherein said shoe cover pulling mechanism comprises first and second stoppers pivotally hinged at said housing at said shoe disposing opening and moved between an idle position and a moving position, wherein in said idle position, said first and second stoppers are arranged for engaging with said standby shoe cover to enlarge said shoe opening of said standby shoe cover, wherein in said moving position, said first and second stoppers are arranged for disengaging with said standby shoe cover for said standby shoe cover being pulled out of said shoe cover feeding arrangement, wherein said first stopper is provided at a front end of said shoe disposing opening while said second stopper is provided at a rear end of said shoe disposing opening, wherein said first and second stoppers are arranged for engaging with front and rear sides of said standby shoe cover respectively so as to retain said standby shoe cover at said open-up condition, wherein at least one of said first and second stoppers is a flexible panel pivotally hinged at said housing for holding said standby shoe cover at said open-up condition.

2. An automatic shoe cover dispenser, comprising:

a shoe cover feeding arrangement, which comprises a housing having a shoe disposing opening, for holding a plurality of shoe covers, each having a shoe opening, being folded and orderly coupled with each other; and a shoe cover pulling mechanism for pulling one of said shoe covers into an open-up condition as a standby shoe cover and for consequently pulling a subsequent shoe cover by said standby shoe cover after said standby shoe cover is dispensed, wherein said shoe cover pulling mechanism comprises first and second stoppers pivotally hinged at said housing at said shoe disposing opening and moved between an idle position and a moving position, wherein in said idle position, said first and second stoppers are arranged for engaging with said standby shoe cover to enlarge said shoe opening of said standby shoe cover, wherein in said moving position, said first and second stoppers are arranged for disengaging with said standby shoe cover for said standby shoe cover being pulled out of said shoe cover feeding arrangement, wherein said housing has a rear outlet communicating with said shoe disposing opening and defines said shoe disposing opening at a top opening arranged for aligning with said shoe opening of said standby shoe cover at said open-up condition, wherein said housing further comprises two sliding tracks extending in parallel to define said shoe disposing opening between said sliding tracks for slidably guiding each of said shoe covers sliding towards said shoe disposing opening, wherein said first and second stoppers are coupled at said sliding tracks.

3. An apparatus, comprising:

a plurality of shoe covers each having a shoe opening; and an automatic shoe cover dispenser, which comprises:

a shoe cover feeding arrangement which comprises a housing having a shoe disposing opening, wherein said shoe covers are held by said shoe cover feeding arrangement; and a shoe cover pulling mechanism for pulling one of said shoe covers into an open-up condition as a standby shoe cover and for consequently pulling a subsequent shoe cover by said standby shoe cover after said standby shoe cover is dispensed, wherein said shoe cover pulling mechanism comprises first and second stoppers pivotally hinged at said housing at said shoe disposing opening and moved between an idle position and a moving position, wherein in said idle position, said first and second stoppers are arranged for engaging with said standby shoe cover to enlarge said shoe opening of said standby shoe cover, wherein in said moving position, said first and second stoppers are arranged for disengaging with said standby shoe cover for said standby shoe cover being pulled out of said shoe cover feeding arrangement, wherein said first stopper is provided at a front and of said shoe disposing opening while said second stopper is provided at a rear end of said shoe disposing opening, wherein said first and second stoppers are arranged for engaging with front and rear sides of said standby shoe cover respectively so as to retain said standby shoe cover at said open-up condition, wherein at least one of said first and second stoppers is a flexible panel pivotally hinged at said housing for holding said standby shoe cover at said open-up condition.

4. An apparatus, comprising:

a plurality of shoe covers each having a shoe opening; and an automatic shoe cover dispenser, which comprises:

a shoe cover feeding arrangement which comprises a housing having a shoe disposing opening, wherein said shoe covers are held by said shoe cover feeding arrangement; and a shoe cover pulling mechanism for pulling one of said shoe covers into an open-up condition as a standby shoe cover and for consequently pulling a subsequent shoe cover by said standby shoe cover after said standby shoe cover is dispensed, wherein said shoe cover pulling mechanism comprises first and second stoppers pivotally hinged at said housing at said shoe disposing opening and moved between an idle position and a moving position, wherein in said idle position, said first and second stoppers are arranged for engaging with said standby shoe cover to enlarge said shoe opening of said standby shoe cover, wherein in said moving position, said first and second stoppers are arranged for disengaging with said standby shoe cover for said standby shoe cover being pulled out of said shoe cover feeding arrangement, wherein said housing has a rear outlet communicating with said shoe disposing opening and defines said shoe disposing opening at a top opening arranged for aligning with said shoe opening of said standby shoe cover at said open-up condition, wherein said housing further comprises two sliding tracks extending in parallel to define said shoe disposing opening between said sliding tracks for slidably guiding each of said shoe covers sliding towards said shoe disposing opening, wherein said first and second stoppers are coupled at said sliding tracks.

* * * * *